US008973774B1

(12) United States Patent
Stravitz

(10) Patent No.: US 8,973,774 B1
(45) Date of Patent: Mar. 10, 2015

(54) WASTE CONTAINER WITH ACTUATABLE, INTERNAL BAG OBSTRUCTION MEMBER

(71) Applicant: David M. Stravitz, New York, NY (US)

(72) Inventor: David M. Stravitz, New York, NY (US)

( * ) Notice: Subject to any disclaimer, the term of this patent is extended or adjusted under 35 U.S.C. 154(b) by 0 days.

(21) Appl. No.: 14/204,226

(22) Filed: Mar. 11, 2014

Related U.S. Application Data

(63) Continuation-in-part of application No. 29/483,029, filed on Feb. 25, 2014, now abandoned.

(51) Int. Cl.
*B65F 1/14* (2006.01)

(52) U.S. Cl.
CPC ..... *B65F 1/14* (2013.01); *Y10S 220/908* (2013.01); *Y10S 220/9081* (2013.01); *Y10S 220/909* (2013.01)
USPC ..... 220/495.06; 220/908; 220/908.1; 220/909; 53/370; 53/483; 53/567

(58) Field of Classification Search
CPC ..... B65F 1/14
USPC ..... 220/495.06, 908, 908.1, 909; 53/370, 53/483, 567
See application file for complete search history.

(56) References Cited

U.S. PATENT DOCUMENTS

| | | | | |
|---|---|---|---|---|
| 6,612,099 | B2 | 9/2003 | Stravitz | |
| 6,804,930 | B2 | 10/2004 | Stravitz | |
| 6,851,251 | B2 | 2/2005 | Stravitz | |
| 7,086,569 | B2 | 8/2006 | Stravitz | |
| 7,114,314 | B2 | 10/2006 | Stravitz | |
| 7,146,785 | B2 | 12/2006 | Stravitz | |
| 7,316,100 | B2 | 1/2008 | Stravitz et al. | |
| 7,406,814 | B2 | 8/2008 | Morand | |
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,617,659 | B2 | 11/2009 | Stravitz et al. | |
| 7,617,660 | B2 | 11/2009 | Morand | |
| 7,708,188 | B2 | 5/2010 | Stravitz et al. | |
| 7,712,285 | B2 | 5/2010 | Stravitz et al. | |
| 7,963,414 | B1 | 6/2011 | Stravitz | |
| 8,127,519 | B2 | 3/2012 | Stravitz | |
| 8,215,089 | B2 | 7/2012 | Stravitz | |
| 8,235,237 | B1 | 8/2012 | Stravitz | |
| 8,266,871 | B1 * | 9/2012 | Stravitz | 53/370 |
| 8,393,489 | B1 | 3/2013 | Stravitz | |
| 2010/0005762 | A1 | 1/2010 | Stravitz | |

* cited by examiner

*Primary Examiner* — Fenn Mathew
*Assistant Examiner* — Elizabeth Volz
(74) *Attorney, Agent, or Firm* — Brian Roffe

(57) ABSTRACT

Waste container including a base defining a waste-receiving compartment, a lid movably attached to the base and movable between a first position covering a waste insertion opening and a second position in which it does not obstruct the waste insertion opening and a support portion including an aperture through which a bag is placed into the compartment. An obstruction mechanism includes an actuator and an obstruction member having at least one part that selectively engages with the bag at a location below the support portion. The actuator is manually and/or automatically rotatable to cause rotation of the obstruction member between a first position in which the obstruction member is in a first plane not obstructing insertion of waste into the bag and a second position in which the obstruction member is in a second plane obstructing insertion of waste into the bag.

20 Claims, 19 Drawing Sheets

FIG. 8
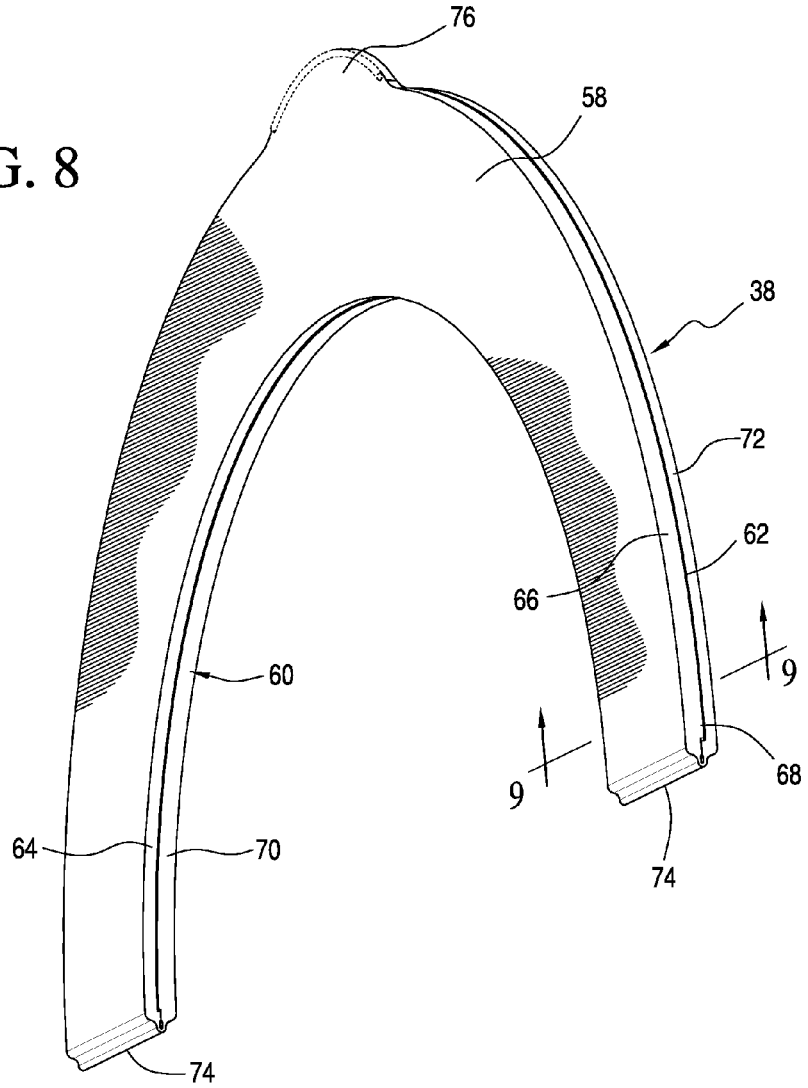
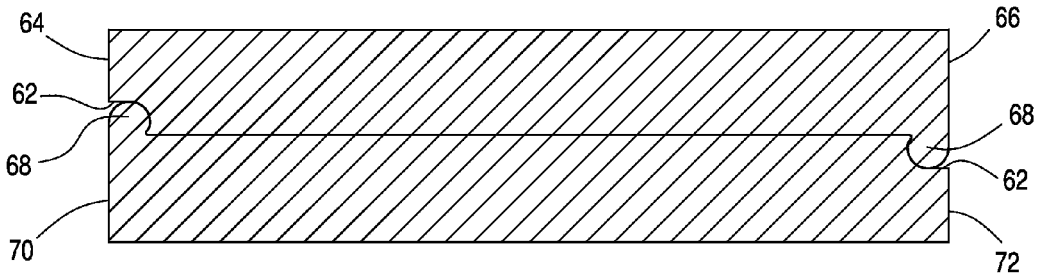
FIG. 9

WASTE CONTAINER WITH ACTUATABLE, INTERNAL BAG OBSTRUCTION MEMBER

FIELD OF THE INVENTION

The present invention relates generally to waste containers or disposal devices that may be used for any type of waste, including but not limited to, cat litter, medical waste from hospitals, doctors' offices, home health care personnel and facilities, nursing homes, biohazard laboratories, diapers, general household waste, disposables, incontinence, and the like.

BACKGROUND OF THE INVENTION

Waste containers or disposal devices are common in hospitals, doctors' offices, kitchens and other household locations and other locations where waste is generated and must be disposed of in a sanitary manner. Waste disposal devices are also often used to dispose of household waste, cat litter and other pet waste. If the waste emits odors, the waste disposal device should also contain odors emanating from the waste.

Numerous waste disposal devices exist including those disclosed in U.S. Pat. Nos. 6,612,099, 6,804,930, 6,851,251, 7,114,314, 7,146,785, 7,316,100, 7,406,814, 7,434,377, 7,503,152, 7,503,159, 7,617,659, 7,617,660, 7,708,188, 7,712,285, 7,963,414, 8,127,519, 8,215,089, 8,235,237 and 8,266,871 all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a lid which is coupled to a rotation mechanism whereby upon forced manual closure of the lid, the rotation mechanism converts the manually-initiated closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

SUMMARY OF THE INVENTION

A waste container in accordance with the invention includes a base defining a waste-receiving compartment, a lid movably attached to the base and movable between a first position covering a waste insertion opening and a second position in which it does not obstruct the waste insertion opening, and a support portion including an aperture through which a bag is placed into the compartment. The container also includes an obstruction mechanism having an actuator and an obstruction member having at least one part that selectively engages with the bag at a location below the support portion. The actuator is manually rotatable to cause rotation of the obstruction member between a first position in which the obstruction member is in a first plane not obstructing insertion of waste into the bag and a second position in which the obstruction member is in a second plane obstructing insertion of waste into the bag. The actuator may be configured to rotate the obstruction member about an axis perpendicular to a vertical axis of the base.

In some embodiments, the actuator includes a rotating rib on a rear side, and the base includes a side wall with click stops that interact with the rib to control rotation of the actuator and thus rotation of the obstruction member. The actuator further includes rotation limiting stops to limit rotation of the actuator, or other comparable rotation limiting means. The obstruction mechanism may also include a manually actuated switch movable between a position in which it can engage the click stops and a position in which it cannot contact the click stops. A biasing mechanism may be provided to bias the actuator into a position in which the obstruction member is in the first position. The switch may include an elongate connecting portion extending between a manually accessible portion and the click stops.

The obstruction member may be connected at only one end to the actuator and have an opposite, free end. Alternatively, the obstruction member is connected at one end to the actuator and at an opposite end to the base. The obstruction member may define a circular, oval-shaped, rectangular or square-shaped aperture through which the bag is passed, such that the obstruction member has two parts that selectively engage with the bag below the support portion. Alternatively, the obstruction member defines a semi-circular portion, semi-rectangular portion or semi-square portion adapted to be situated alongside the bag when present, such that the obstruction member has only a single part that selectively engages with the bag below the support portion.

In one embodiment, the waste container includes a membrane support arranged on the support portion including a membrane and a bag assembly arranged on the membrane support. The bag assembly includes the bag that passes through an opening defined by the membrane.

The bag assembly may be arranged above the support portion and include, in addition to the bag, a foldable support that supports the bag. The support includes two hinged portions and male or female connection elements on each of the inner and outer circumferential edges of each hinged portion configured to cooperate with one another when the hinged portions are folded against one another. The support further includes a supplemental engagement system that aids in maintaining the hinged portions folded against one another. The supplemental engagement system may include at least one projection on a surface of one of the hinged portions and a corresponding shaped aperture on the other of the hinged portions. The projection and corresponding aperture are positioned to engage one another when the hinged portions are folded against one another. The supplemental engagement system may alternatively comprise at least one boss on a surface of one of the hinged portions and a corresponding shaped aperture on the other of the hinged portions. The boss and corresponding aperture are positioned to engage one another when the hinged portions are folded against one another.

In another embodiment of a waste container, there is an automatic rotation of the obstruction member upon closure of the lid, i.e., the manual actuation of the actuator in the embodiments described above is not required. In this embodiment, the obstruction mechanism includes an obstruction member having at least one part that selectively engages with the bag. The obstruction member is rotatable upon movement of the lid to cause rotation of the obstruction member between a first position in which the obstruction member is in a first plane not obstructing insertion of waste into the bag when the lid is open and a second position in which the obstruction member is in a second plane obstructing insertion of waste into the bag when the lid is closed.

As an example of the mechanism that couples the lid movement to the obstruction member rotation, a member may be attached to the lid and that moves in one direction when the lid is opened and in an opposite direction when the lid is closed, and a mechanism provided that converts the movement of the member into rotational movement of the obstruction member. This latter mechanism may include a rod attached to the member and an arm pivotally attached to an end region of the rod and to the obstruction member. A spring may be provided and configured to be placed into a biased state when the lid is opened and thereby causes return closure of the lid and thus rotation of the obstruction member into the second position.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 8 is a perspective view of the first embodiment of the foldable support for a flexible bag used with the waste container shown in FIG. 1, when in a folded state;

FIG. 9 is a cross-sectional view of the first embodiment of the foldable support for a flexible bag used with the waste container shown in FIG. 1 taken along the line 9-9 in FIG. 8;

DETAILED DESCRIPTION OF THE INVENTION

Figure 1:
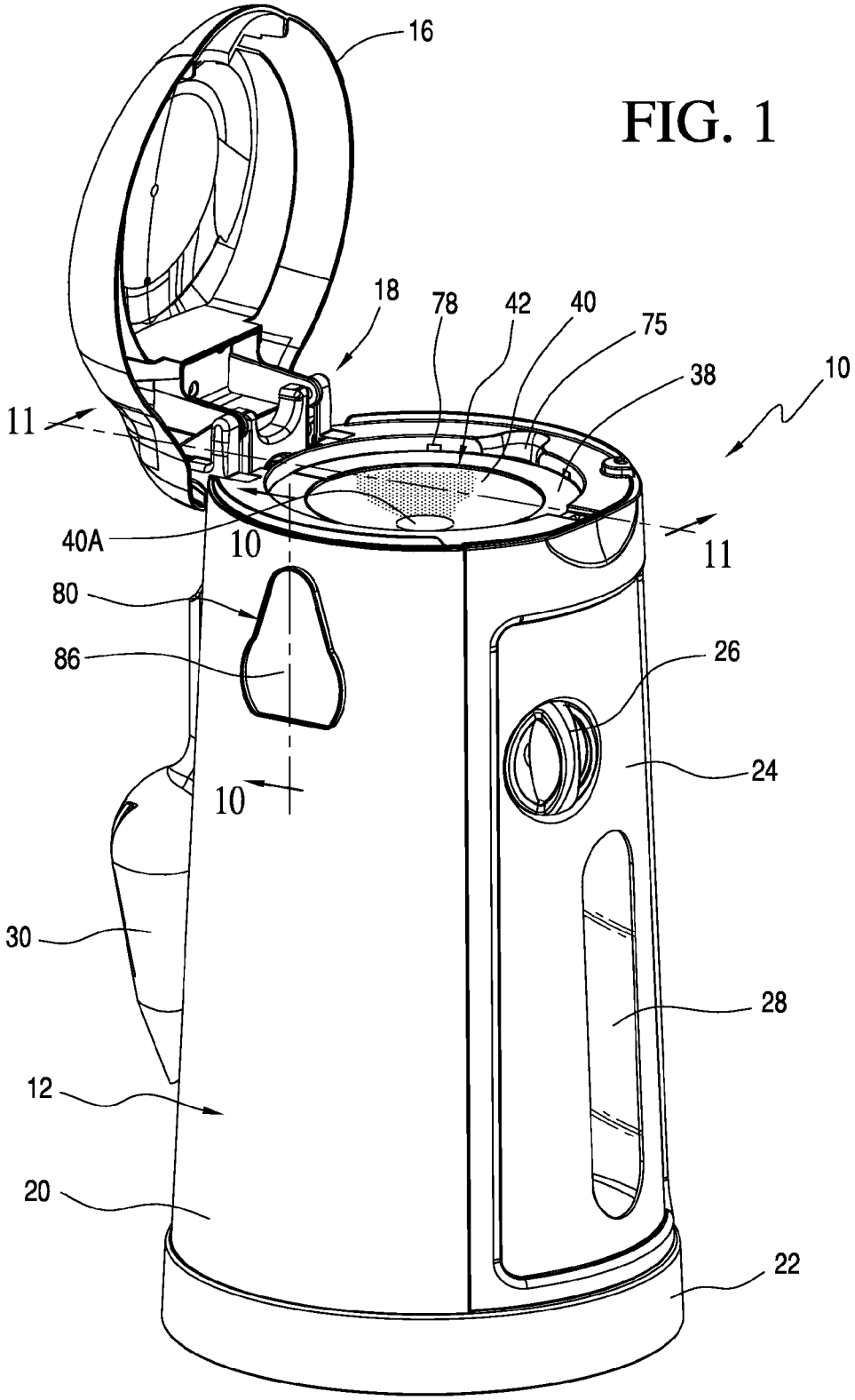
FIG. 1 is a perspective view of a first embodiment of a waste container in accordance with the invention shown with its lid in an open state.
Figure 2:
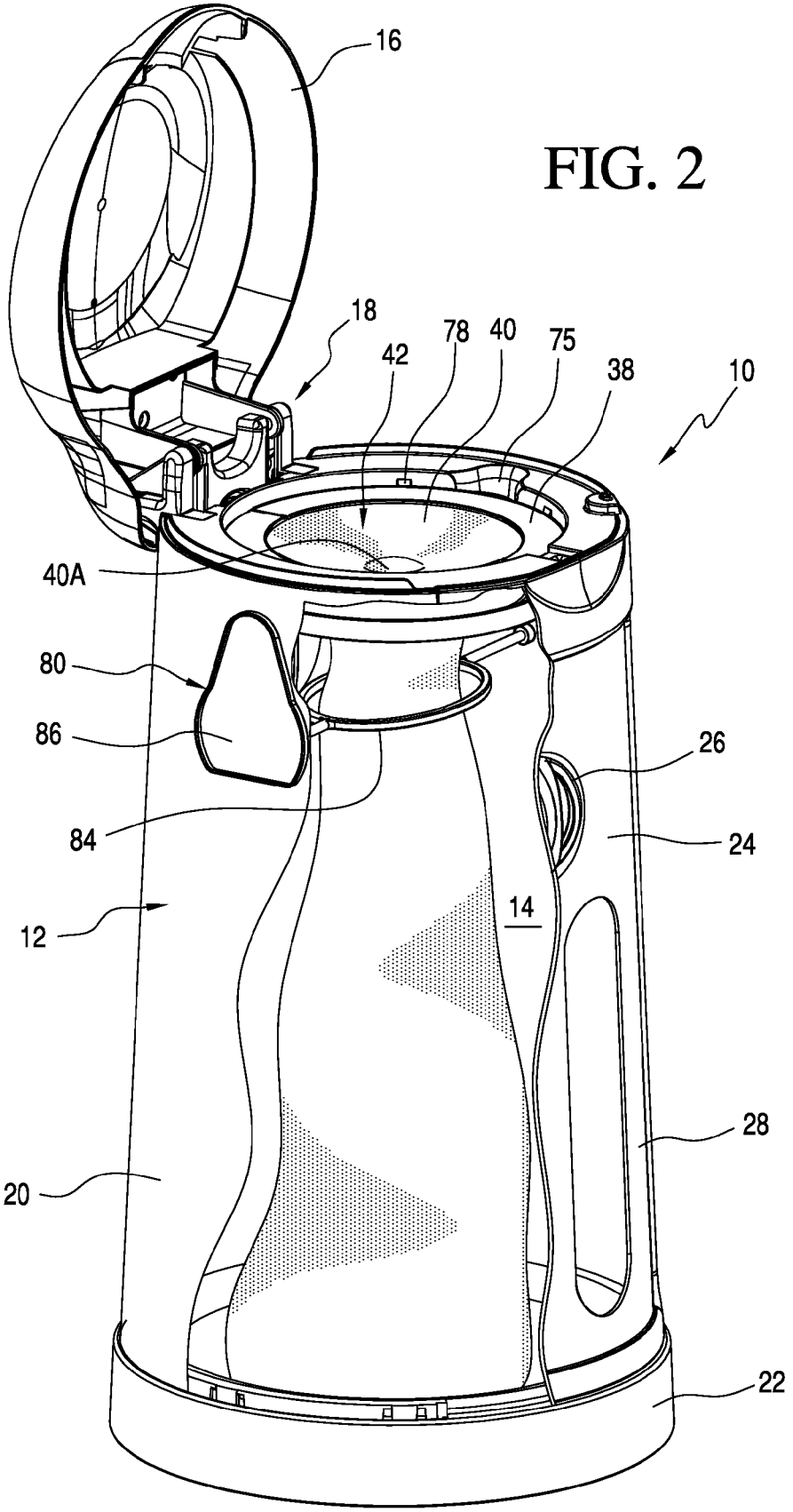
FIG. 2 is a perspective view of the waste container shown in FIG. 1 partially broken away to show a first embodiment of an obstruction member and bag in the interior of the container.

Referring to the accompanying drawings wherein like reference numerals refer to the same or similar elements, a first embodiment of a waste container in accordance with the invention is shown in FIGS. 1 and 2 and is designated generally as 10. Container 10 includes a base 12 defining a waste-receiving compartment 14. A lid 16 is movably attached to the base 12 and moves between a first position covering a waste insertion opening, i.e., prevents insertion of waste into the waste-receiving compartment 14 and a second position in which it does not obstruct the waste insertion opening, i.e., enables insertion of waste (see FIGS. 1 and 2).

The lid 16 may be pivotally mounted to a rear, upper edge of the base 12 by any type of pivotal mounting mechanism 18. Generally, the pivotal mounting mechanism 18 would include one or more parts on the base 12 and one or more cooperating parts on the lid 16. Instead of a pivotal mounting mechanism, another type of mechanism that enables the lid 16 to move while mounted to the base 12 between a closed position and an open position shown in FIGS. 1 and 2 may be used in the invention, including any known to those skilled in the art of waste containers. Such a mechanism will be referred to herein as a lid mounting mechanism or lid mounting means. In this embodiment, the lid 16 is independent of the position of an actuator and an obstruction member, described below. As such, the opening and closing movement of the lid 16 does not have an effect on the movement of the actuator and obstruction member, i.e., lid movement is decoupled from actuator and obstruction member movement. In other embodiments described below, there is a coupling between the movement of the lid 16 and the movement of the actuator and obstruction member.

Base 12 includes a generally cylindrical body. Alternatively, the body of the base 12 may be other shapes, such as square, rectangular, oval, etc. The base 12, regardless of its shape, would include a circumferential side wall 20 and a bottom support 22. Side wall 20 includes an access door 24 having a conventional attachment mechanism to enable it to be opened by pulling on a handle 26 and closed as desired, e.g., one or more hinges situated on the interior of the side wall 20. Handle 26 can also serve as an access control member to selectively lock the door 24 or enable the door 24 to be opened by pulling on the handle 26. Thus, the handle 26 may be configured to be rotatable between two positions, one in which it is engaged with an edge of the side wall 20 surrounding the opening for the door 24 and another position in which it is not engaged and separable from the side wall edge. A user would turn the handle 26 in one direction to the latter position to open the door 24 and after accessing the interior of the base 12, would close the door and then turn the handle 26 to secure it to the base 12. Instead of the handle 26, any other structure that enables selective manual access to the compartment 14 is encompassed within the scope of the invention Door 24 also includes a window 28 that preferably extends vertically as shown to enable easy viewing of the condition of a bag 40 in the compartment 14 vis-à-vis its state of fullness. The window 28 is preferably made of a clear or transparent material, e.g., plastic or glass. By providing the window 28, a user has the option to view whether the bag 40 is full or not and based thereon, determine when it is appropriate to remove the bag 40 and replace it with a new bag 40.

A scoop 30 is optionally provided with the container 10 (see FIG. 1). Scoop 30 enables waste, such as kitty litter, to be handled without physical contact and deposited into the waste insertion opening of the container 10. To hold the scoop 30 on the container 10, the side wall 20 of the base 12 includes a hook 32 (see FIG. 11). Other retaining structure to hold the scoop 30 in connection with the container 10 generally and the base specifically may be used, and are considered to be encompassed within scoop retaining means in accordance with the invention.

Figure 10:
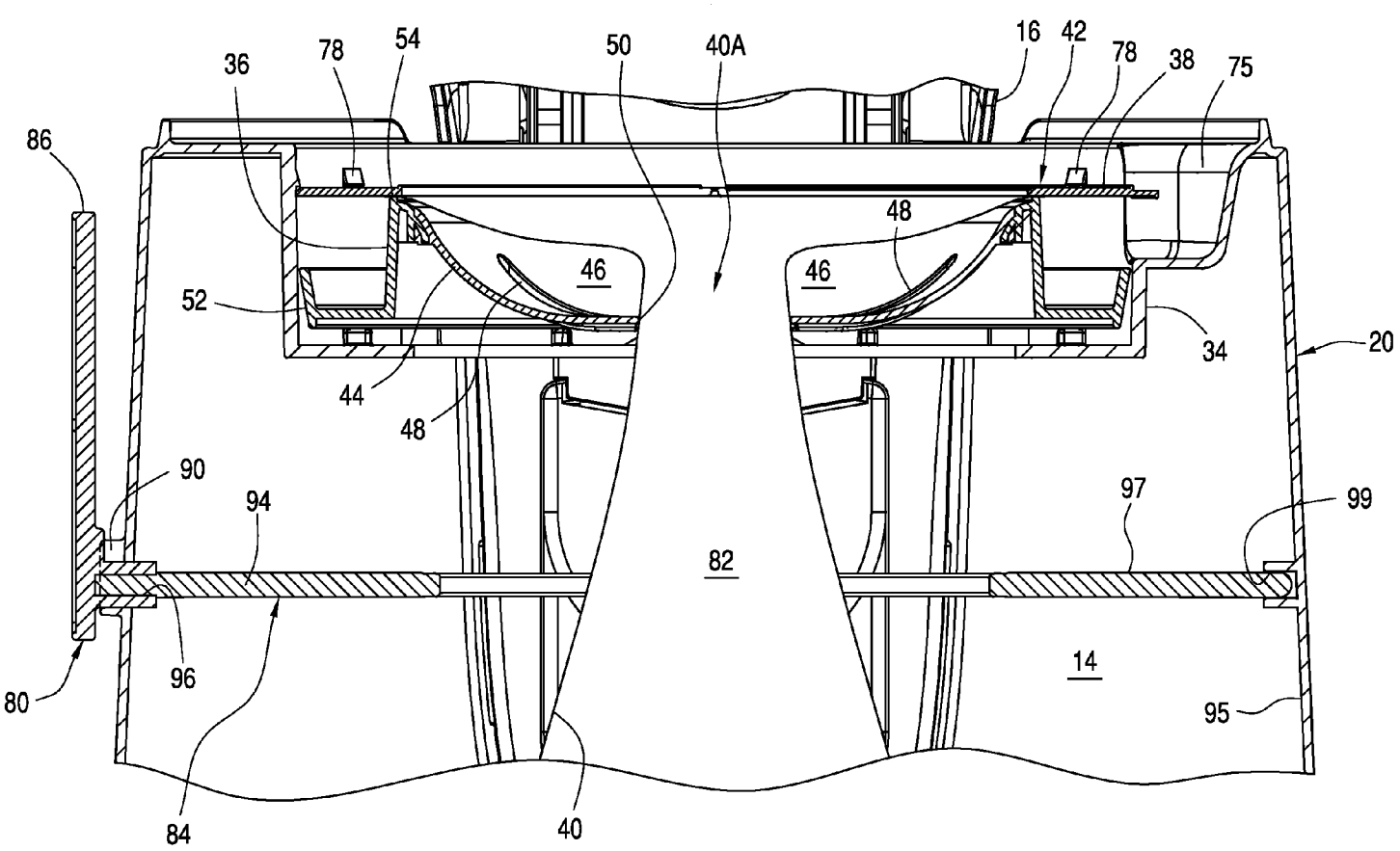
FIG. 10 is a cross-sectional view of the waste container shown in FIG. 1 taken along the line 10-10 in FIG. 1.
Figure 11:
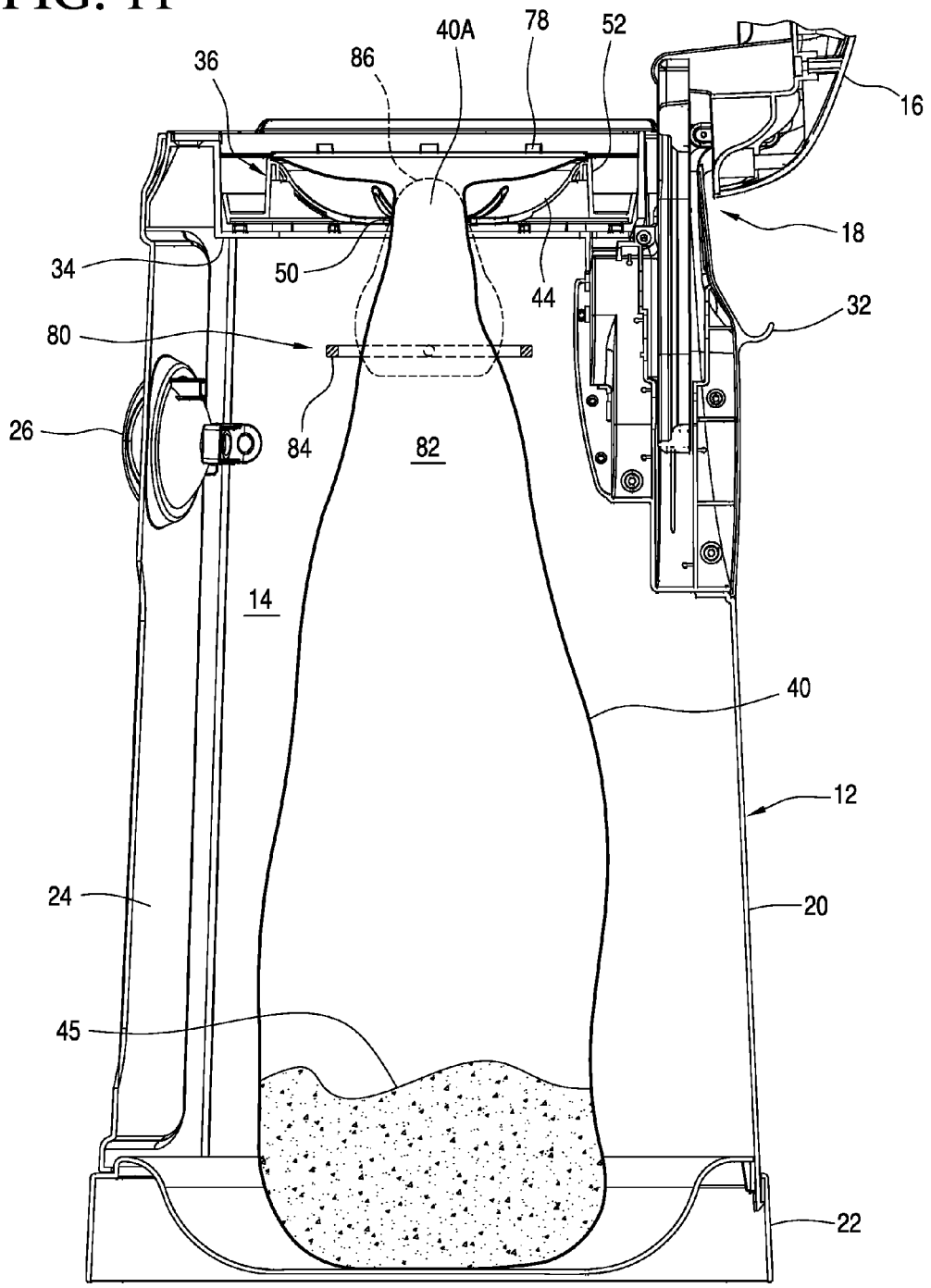
FIG. 11 is a cross-sectional view of the waste container shown in FIG. 1 taken along the line 11-11 in FIG. 1, showing the first embodiment of the obstruction member in a first position.

Base 12 includes a support portion 34 on which a membrane support 36 rests or is retained, and a foldable bag support 38 in turn rests or is retained on the membrane support 36 (see FIGS. 10 and 11). Bag support 38 may be circular as shown, and could fit into a container having any cross-sectional shape. That is, the bag support 38 may be circular and fit into an oval or rectangular-shaped container.

Bag support 38 is attached to a flexible bag 40 to form a bag assembly 42. To use the container 10, the bag assembly 42 is placed such that the bag support 38 rests on the membrane support 36 and the bag 40 is urged into the compartment 14 (see FIGS. 2, 10 and 11).

Membrane support 36 includes a flexible membrane 44 that has a plurality of slots 46 between fingers 48 of the membrane 44 (see FIGS. 10 and 11). The slots 46 provide the membrane 44 with flexibility to enable insertion of waste into the bag 40 that overlies the membrane 44 with a portion of the bag 40 being passed through a central opening 50 of the membrane 44.

More specifically, the bag 40 overlies the membrane 44 to define a bag aperture 40A which forms at the central opening 50 of the membrane 44 (see FIG. 10). This bag aperture 40A is exposed when the lid 16 is pivoted upward relative to the base 12 (see FIGS. 1 and 2). The bag aperture 40A is covered when the lid 16 is closed.

The membrane 44 may be formed and constructed in different ways and is not limited to the presence of any set number of fingers 48 separated by a respective number of slots 46. The material of the fingers 48 may be selected to be flexible so that they flex downward in a direction away from the center when a person pushes waste through the central region of the membrane 44. The material of the fingers 48 should also be resilient so that the fingers 48 return to their initial form after the person has removed their hand from engagement with the membrane 44, or the inserted waste has been pushed downward through the membrane 44 and is no longer in engagement therewith.

For example, the membrane 44 may be made of silicone or another rubbery material. It may also be made of a flexible synthetic material which flexes under pressure and returns when pressure is removed. The edges of the fingers 48 which are expected to engage the bag 40 may be provided with a friction-enhancing material to increase the contact force between the fingers 48 and the bag 40. Alternatively, other membranes, such as disclosed in U.S. Pat. No. 8,215,089 (Stravitz) and U.S. Pat. No. 8,266,871 (Stravitz) and other patents by the inventor, all of which are incorporated by reference herein, may be used in the invention. Central opening 50 of the membrane 44 can have a smaller or larger opening depending upon, for example, the application of the waste container 10, e.g., a larger opening if the waste container 10 is primarily intended for use with kitty litter and for hands-free use to dispose of medical waste, and perhaps a smaller opening if the waste container 10 is primarily intended for manual insertion of soiled diapers. The size of the opening 50 of the membrane 44 does not in any way limit the use of the waste container 10.

Furthermore, the membrane 44 is preferably molded in a resilient substrate that can be adjusted for proper rigidity depending on the application. Polypropylene is one such material. The membrane 44 can also be reinforced with some ribbing to give it strength to return substantially to its relaxed shape. The slots 46 and fingers 48 of membrane 44 may have different sizes and shapes for specific applications.

Membrane 44 may be formed integral with a membrane support portion 52 to provide a unitary membrane support 36 or separate therefrom and then attached thereto. The membrane support portion 52 also includes an upper edge 54 on which the bag support 38 rests (see FIG. 10).

Membrane support 36 (FIGS. 10 and 11) is an optional component of the container 10 and the container 10 is functional without the membrane support 36, and without a membrane 44. That is, the support portion 34 of the base 12 configured with an aperture may constitute the waste insertion aperture of the container 10. When a membrane 44 is present, the waste insertion aperture of the container 10 may be constituted by the membrane opening 50. However, the membrane support 36 is important in some embodiments for trapping the bag support 38 between and the retaining projections 78, described below. Once trapped, the bag support 38 is stabilized and restrained from caving in or prematurely folding. Therefore, the membrane support 36, although optionally retaining a membrane 44, should be provided for its function relative to the bag support 38, i.e., assisting in trapping the foldable bag support 38. If another bag support, such as a rigid, non-weakened support is used that does not require restraint against caving in and folding, then the membrane support 36 might be eliminated.

Figure 6:
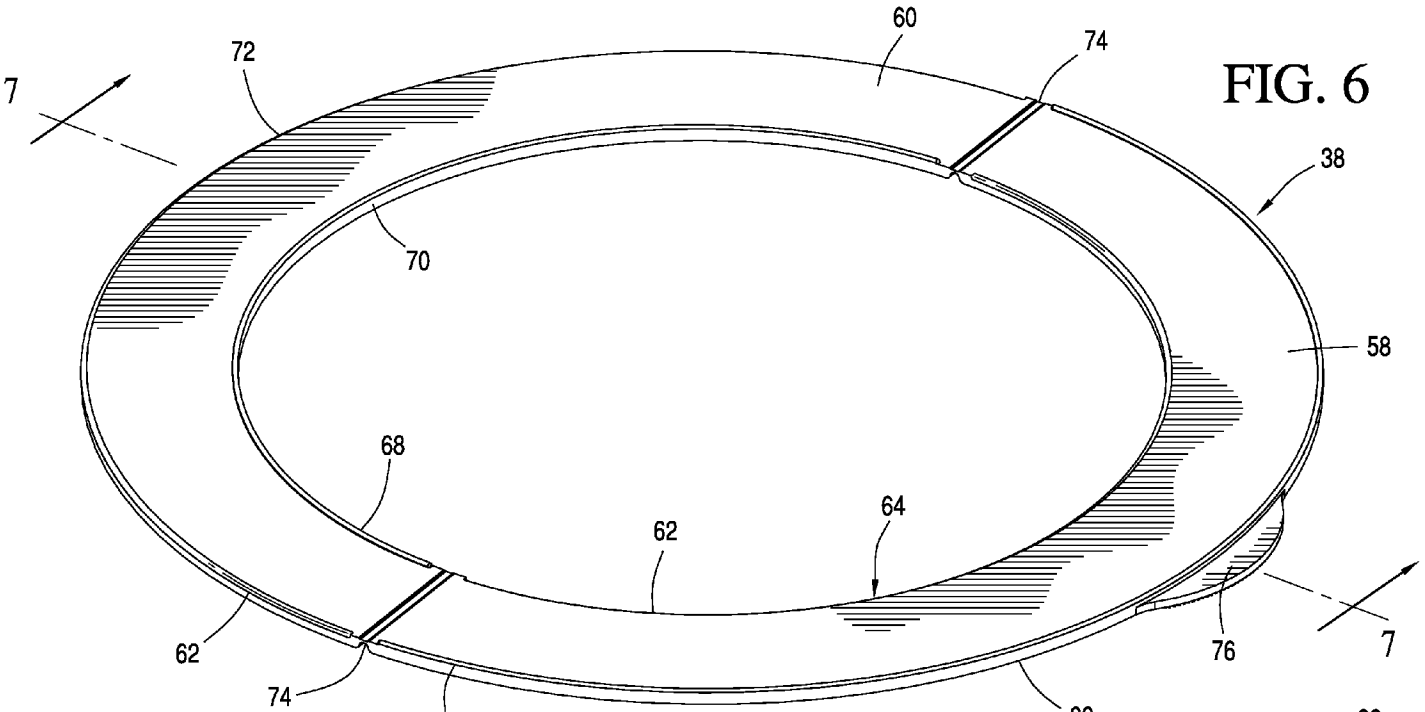
FIG. 6 is a perspective view of a first embodiment of a foldable support for a flexible bag used with the waste container shown in FIG. 1, when in an operational state.
Figure 7:
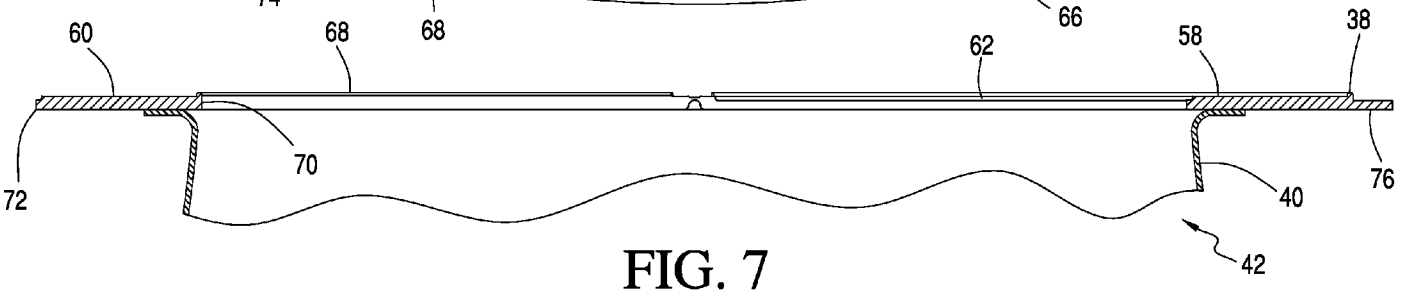
FIG. 7 is a cross-sectional view of the first embodiment of the foldable support for a flexible bag used with the waste container shown in FIG. 1 taken along the line 7-7 in FIG. 6.

The bag assembly 42 is shown in FIG. 7 and includes the foldable support 38 shown in FIGS. 6, 8 and 9. Foldable support 38 has a tabbed portion 58 and a non-tabbed portion 60. On the tabbed portion 58, a female connection element 62 is arranged at the inner circumferential edge 64 and a male connection element 68 is arranged at the outer circumferential edge 66. The female connection element 62 is a groove formed at the circumferential corner (see FIG. 9). On the non-tabbed portion 60, a male connection element 68 is arranged at the inner and outer circumferential edges 70, 72, respectively. The male connection elements 68 are ribs or projections formed at the circumferential corners, and that are preferably rounded (see FIG. 9). The male connection elements 68 snap into the female connection elements 62 to provide a secure connection of the tabbed portion 58 and non-tabbed portion 60 together to provide the foldable bag support 38 with a stable, folded state shown in FIG. 8.

Hinges 74 are situated between the tabbed and non-tabbed portions 58, 60 (see FIGS. 6-8). Hinges 74 enable the bag support 38 to be altered from the operational or use state shown in FIG. 6 to the folded state shown in FIG. 8. When the bag support 38 is in the folded state, the bag 40 is closed, thereby sealing odors therein.

Tabbed portion 58 also includes a tab 76 which enters into a corresponding receiving portion on the membrane support 36 (see FIGS. 1, 2 and 10). This prevents rotation of the bag assembly 42. Other structure that serves to prevent rotation of the bag support 38 relative to the membrane support 36 may also be used in the invention, such as those described in the inventor's other patents and patent publications, such as those in the patents and patent publications mentioned above and incorporated by reference herein. Such rotation prevention structure will considered to constitute rotation prevention means in accordance with the invention.

The bag 40 is attached to the lower surface of the tabbed and non-tabbed portions 58, 60 (see FIG. 7). This attachment may be by any manner known to those skilled in the art, e.g., adhesive and the application of heat.

An advantage of the embodiments of the waste container 10 described herein using the bag assembly 42 is that an inner liner for the base 12 is not required. Rather, the bag 40 serves as the liner for the base 12 and prevents waste from coming into contact with the inner surfaces of the base 12.

The type of bag 40 used in the containers disclosed herein may be any type of bag known to those in the waste disposal art. Any type of commercial garbage bag may be used. Deodorizing garbage bags may be used, e.g., a bag made of 7 layer EVOH and serves as an oxygen barrier. For some uses of the container 10, e.g., for cat litter and medical waste, it is preferable that the bag 40 not touch the bottom of the compartment 14 to allow for a cleaner funnel for gravity related substrates. This will insure a better tapered opening to receive the waste, especially as the bag 40 takes on weight from accumulating waste. On the other hand, a longer bag that rests on the bottom support 22 of the container 10 has the advantage of not causing strain on an actuator 86 to return to its starting position, described below.

To retain the bag assembly 42 on the base 12, one or more retaining projections 78 are arranged on the support portion 34 (see FIGS. 1, 2, 10 and 11).

The bag assembly 42 is supported by placing or snapping it under the retaining projections 78, which may also be considered one-directional tabs, traps or stand-offs, while resting on the membrane support 38, thus trapping the bag assembly 42 from movement when waste 45 is inserted into the bag 40. The tab 76 of the bag assembly 42 is conveniently registered in a recess 75 of the container 10 (see FIGS. 1 and 10). Specific siting of this recess 75 enables convenient placement of the bag assembly 42 at an angle of about 90 degrees from the two hinges 74 (see FIG. 1). Lifting the tab 76 when the bag 40 is full of waste 45 folds the bag support 38 exactly and neatly in half.

Preferably a plurality of retaining projections 78 are provided and may be spaced as desired around the peripheral wall of the support portion 34. Retaining projections 78 have an angled surface that extends further from the peripheral wall of the support portion 34 in the direction toward the bottom of the base 12 so that the bag support 38 must be urged downward over the retaining projections 78 into a position on the upper edge 54 of the membrane support portion 52 of the membrane support 38 (see FIGS. 10 and 11). Once in this position, the bag support 38 is secured between the retaining projections 78 (from the top) and the membrane support portion 52 (from the bottom) and thus cannot be easily removed from the base 12. Removal of the bag support 38 and thus the bag assembly 42, from the base 12 would require manual force to pull the bag support 38 upward over the retaining projections 78.

Figure 12:
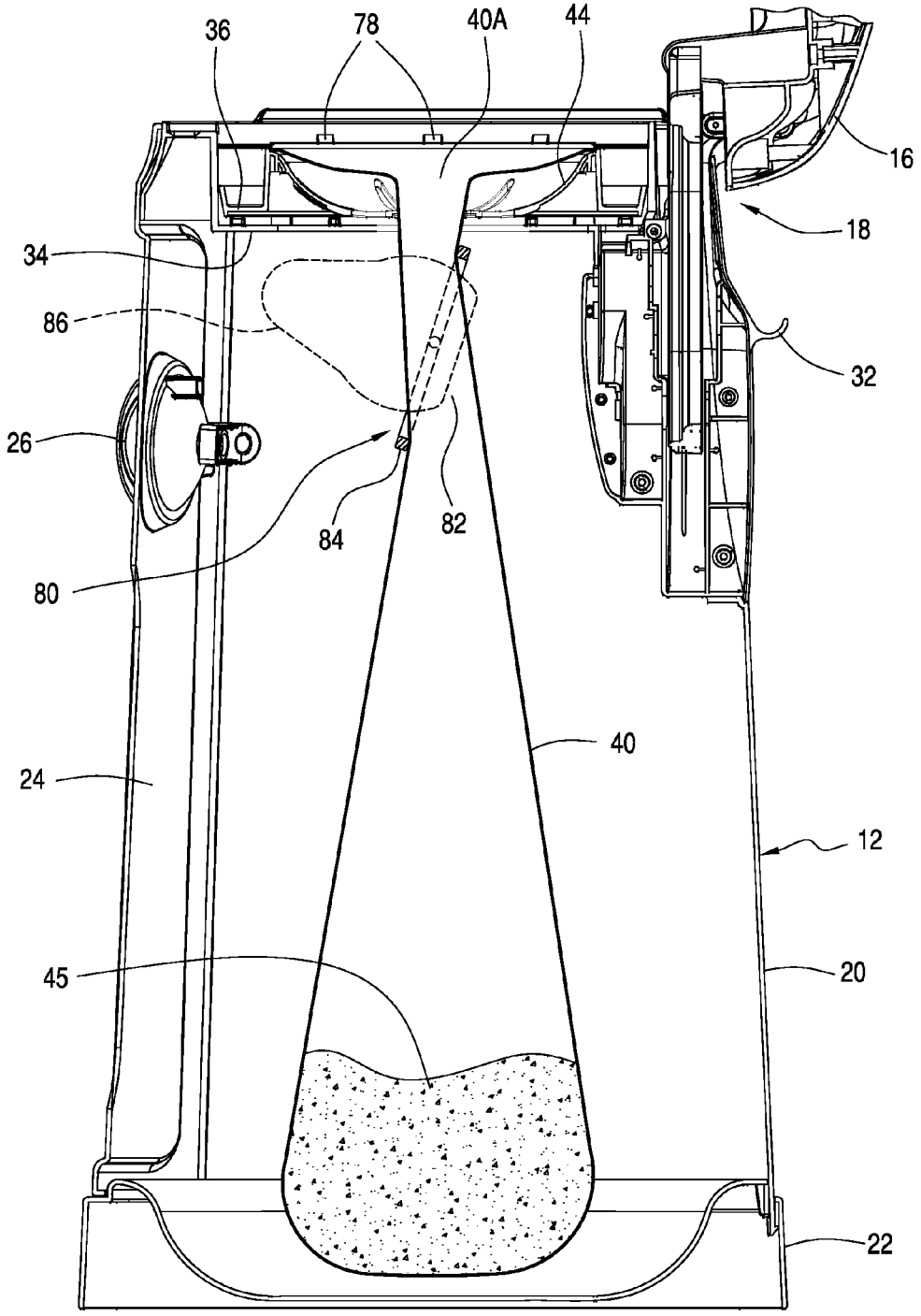
FIG. 12 is another cross-sectional view of the waste container shown in FIG. 1 taken along the line 11-11 in FIG. 1, showing the first embodiment of the obstruction member in a second, partly choking position.

The base 12 also includes a mechanism 80 that selectively obstructs a bag channel 82 defined by the bag 40 and through which waste is inserted into the bag 40 (see FIGS. 10 and 11). This channel 82 extends between the waste insert opening 40A and the bottom of the bag 40. The obstruction mechanism 80, also referred to herein as bag obstruction or choking means, includes an obstruction member 84 that selectively engages with (contacts) the bag 40 to enable the bag channel 82 to be open (allowing for waste insertion) or to be closed (providing odor sealing), see FIGS. 11-13).

Figure 13:
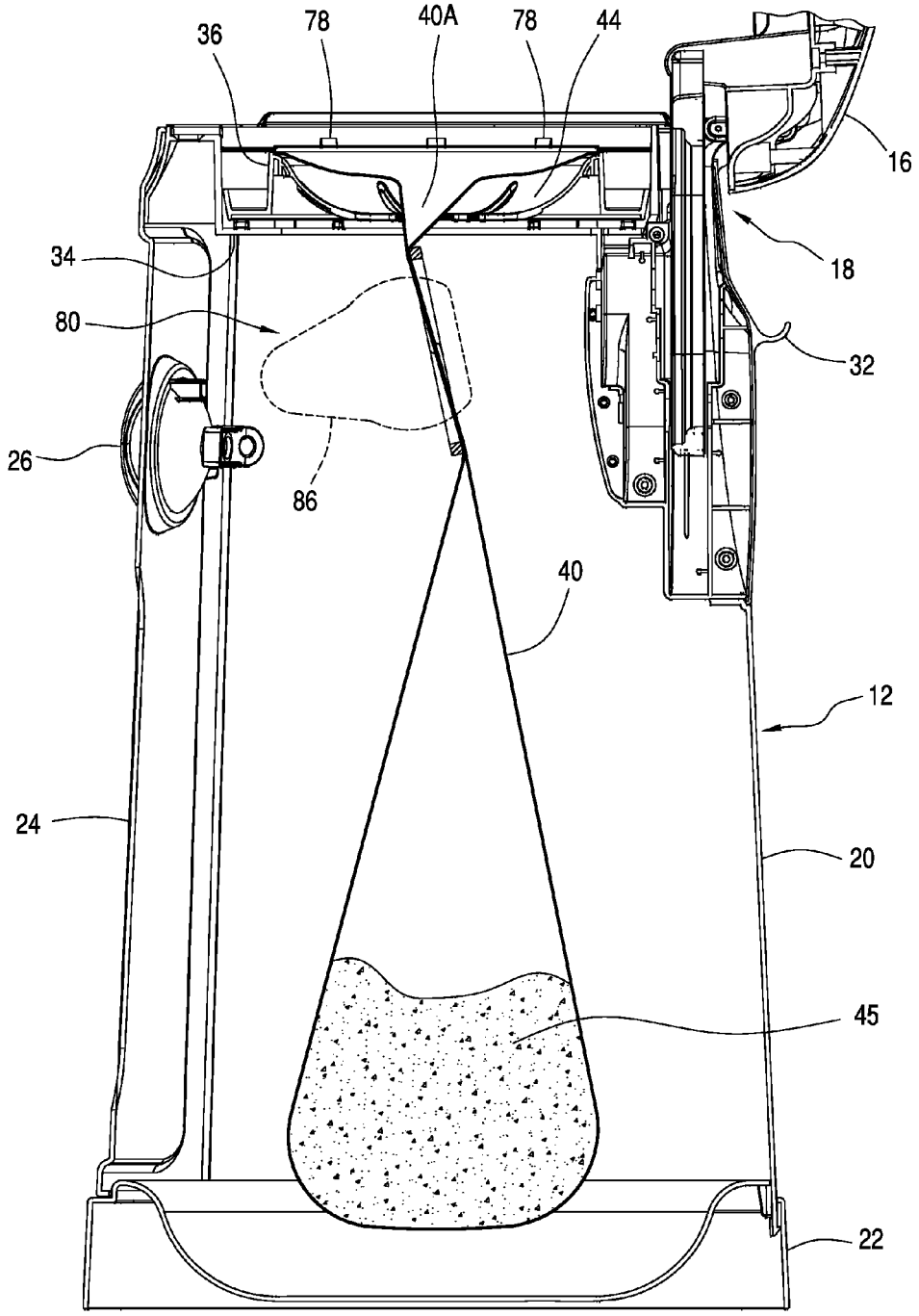
FIG. 13 is another cross-sectional view of the waste container shown in FIG. 1 taken along the line 11-11 in FIG. 1, showing the first embodiment of the obstruction member in a third, fully choking position.

In a general sense, the obstruction mechanism 80 includes a manual actuator 86 and the obstruction member 84 that has at least one part that selectively engages with the bag 40 at a location below the support portion 34, with the actuator 86 being rotatable to rotate the obstruction member 84 between a position in which it is in a first, possibly horizontal plane (see FIGS. 10 and 11) and a position in which it is in a second, possibly vertical plane. In the latter case, the obstruction member 84 could be rotated preferably more than 90 degrees past the vertical plane, e.g., about 110 degrees as shown in FIG. 13. Beyond 110 degrees, there may be undo strain on the bag 40 and actuator 86, although the angle range is not limited by 110 degrees because it is possible to suitably design the actuator and/or bag 40 to avoid such strain for an angle greater than 110 degrees. The rotation also does not have to start with the obstruction member 84 in a horizontal plane but can start with the obstruction member 84 slight angled from the horizontal plane, just preferably not interfering with the passage of waste through the bag channel 82 defined by the bag 40. Also, the rotation of the obstruction member 84 is generally about an axis substantially perpendicular to a vertical axis of the base 12. That is, the obstruction member 84 does not rotate about an axis parallel to the axis of the base 12, extending from the bottom support 22 to the lid 16.

More specifically, the actuator 86 of the obstruction mechanism 80 is coupled to the obstruction member 84, e.g., attached or connected directly thereto, and rotates the obstruction member 84 between the bag channel flow position (see FIGS. 2, 10 and 11) and the bag channel choke position (see FIG. 14), through an intermediate position (see FIG. 13). The actuator 86 is situated alongside the side wall 20 of the base 12 and, in the illustrated embodiment, has a generally planar shape. Its actual shape may be as desired to enable easy and convenient manual manipulation and rotation.

Figure 3:
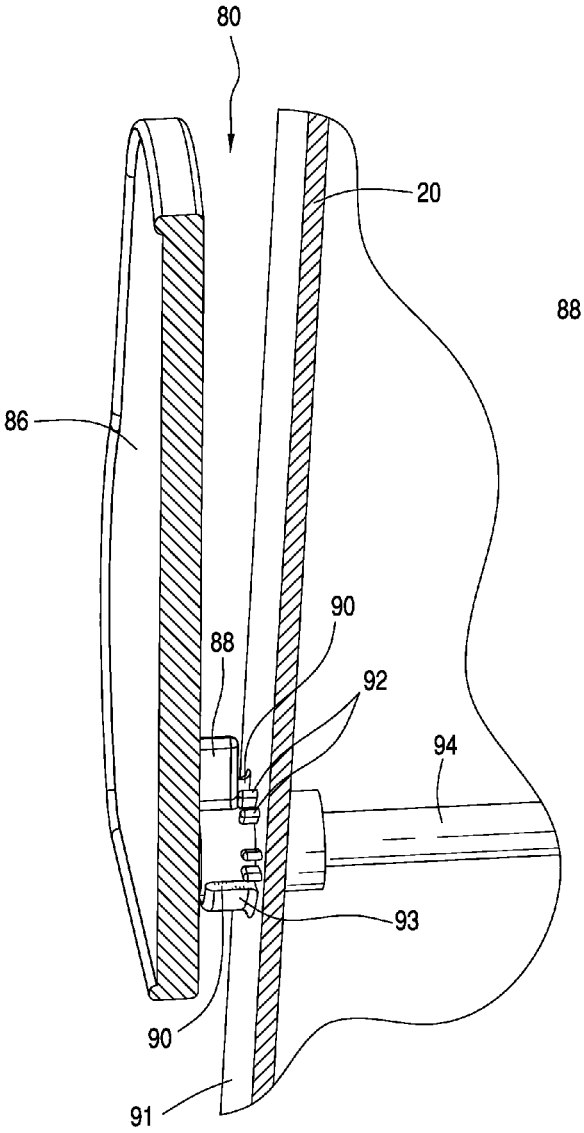
FIG. 3 is a cross-sectional view through an actuator of the waste container shown in FIG. 1.

As shown in FIG. 3, the actuator 86 includes a rotating rib 88 on a rear side that cooperates with rotation limiting stops 90 on the outer surface 91 of the side wall 20 of the base 12. The stops 90 limit the rotational movement of the rib 88). The stops 90 may be formed by two surfaces of a single arcuate member 93, i.e., that has an opening that rotationally limits the movement of the rib 88 (see FIG. 3). The side wall 20 of the base 12 also includes click stops 92, i.e., a series of projections that serve to interact with the rib 88 on the actuator 86 to facilitate control of the rotation of the actuator 86 (see FIG. 3). The rib 88 is preferably bull-nosed and engages the also preferably bull-nosed click stops 92 slightly to provide for limited engagement and allow the rib 88 to pass over the click stops 92. The number of click-stops 92 can be selected to provide a gentle rotation of the rib 88 or a more violent rotation of the rib 88, when being manually rotated between the vertical position shown in FIG. 4 in which the obstruction member 84 (FIG. 11) is in the bag channel flow position to the horizontal position shown in FIG. 5 in which the obstruction member 84 is in the bag channel choking position (FIG. 13). The more jarring caused by the engagement of the rib 88 and click stops 92, the more the bag 40 is shaken, leading to more waste 45 being urged toward the bottom of the bag 40. Jarring shaking of the bag 40 would also cause detritus on the bag 40 to separate from the bag 40.

Figure 4:
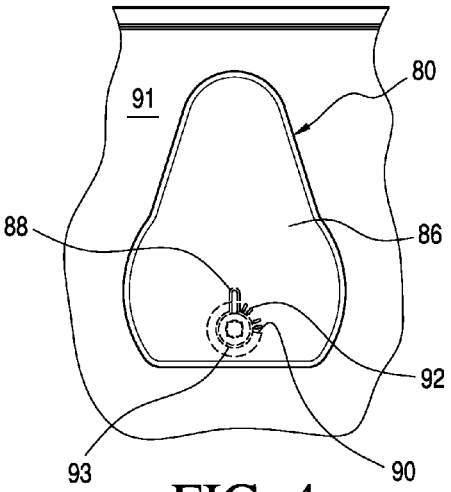
FIG. 4 is a front view of the actuator of the waste container shown in FIG. 1 and its surrounding environment, in a first position.
Figure 5:
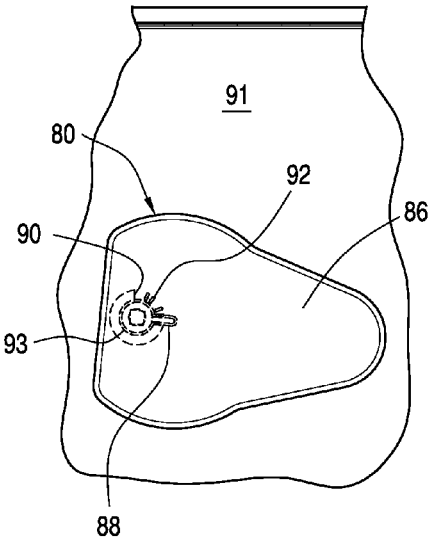
FIG. 5 is a front view of the actuator of the waste container shown in FIG. 1 and its surrounding environment, in a second position.

There are four click stops 92 in the illustrated embodiment and the rotation limiting stops 90 on the outer surface 91 of the side wall 20 of the base 12 are positioned to allow for an approximately 90 degree rotation of the actuator rib 88 (between the positions shown in FIGS. 4 and 5). The design of the click stops 92 serves to keep the actuator 86 in place at any given rotational position.

The click stops 92 cooperating with the actuator 86 constitute a means for regulating the amount of opening or closure on the upper portion of the bag 40. Moreover, the click stops 92 and cooperating actuator 86 constitute a means to impact one or two locations along the substantially upper region of the bag 40 where the upper and lower bag-contact parts of the obstruction member 84 choke the bag. This impact will assist in the waste matter being shaken down from the bag surfaces into the interior of the bag 40. This is advantageous in providing (assisting) kitty litter or medical bandages that might adhere or get stuck in the passageway of the upper opening of the bag 40. This impact or shaking function will also assist in dislodging waste matter and allow gravitational force to do the rest. Other means to regulate the rotation of the obstruction member 84 when actuated via the actuator 86, including those known to person skilled in the art to which this invention pertains, are also considered to be within the scope and spirit of the invention.

The obstruction mechanism 80 also includes a shaft 94 that connects the actuator 86 to the obstruction member 84 (see FIG. 10). Shaft 94 may be formed integral with the obstruction member 84, and is retained in a channel 96 formed on the actuator 86 (see FIG. 10). Similarly, an opposite end of the obstruction member 84 includes a shaft 97 that is received in a channel 99 formed by the side wall of the base 12 on the inner surface 95 thereof, and the shaft 97 may also be formed integral with the obstruction member 84 (see FIG. 10).

Another way to consider the obstruction mechanism 80 is as a structure defining a hoop through which the bag 40 passes. This hoop is rotatable about a generally horizontal axis, i.e., perpendicular to the vertical axis defined by the vertical height of the container 10. Hoop rotation either allows for the bag channel 82 to be open to allow for waste insertion toward the bottom of the bag 40, or choking of the bag channel 82 and thus prevention of odor release and bacteria egress. It is possible to configure the obstruction mechanism 80 to have the hoop start in the choking position and require rotation to the non-obstructing position for waste insertion and then require rotation back to the choking position (either manual or automatic using a biasing mechanism as described below). The alternate configuration is also envisioned, i.e., have the hoop start in the non-obstruction position and require rotation to the choking position for waste insertion and then require rotation back to the non-obstructing position (either manual or automatic using a biasing mechanism as described below). The latter configuration is described in greater detail as follows.

Referring again to FIG. 11, in use of the waste container 10, the bag 40 rests on the bottom of the compartment 14 and the actuator 86 is position such that obstruction member 84 is in the bag channel flow position, i.e., in an non-obstructing position. After waste 45 is inserted into the bag opening 40A, e.g., using the scoop 30, the actuator 86 is rotated to cause two parts of the obstruction member 84 to contact the bag 40. The obstruction member 84 therefore begins to seal (choke) the bag channel 82. As the obstruction member 84 is further rotated, the bag height is gradually reduced. If the bag 40 is lifted off of the bottom support 22, then the seal becomes tighter at both engagement points where the obstruction member 84 contacts the bag 40. A longer bag, on the other hand, may be used and would put less strain on the choke.

Rotation of the actuator 86 continues until the rotation limiting stop 90 is reached, at which point the obstruction member 84 should be in the position shown in FIG. 13, with the bag channel 82 fully choked. This may be a total rotation of about 110 degrees, past vertical to insure a tighter obstruction (choke). This prevents odor from being released from the waste in the interior of the bag 40, and safely contains bacteria in the bag 40. It can be seen that the bag 40 is lifted off of the bottom support 22. If a longer bag is used, then the bag 40 would still rest on the bottom support 22 in the choked position which would produce less strain on the actuator 86.

Figure 14:
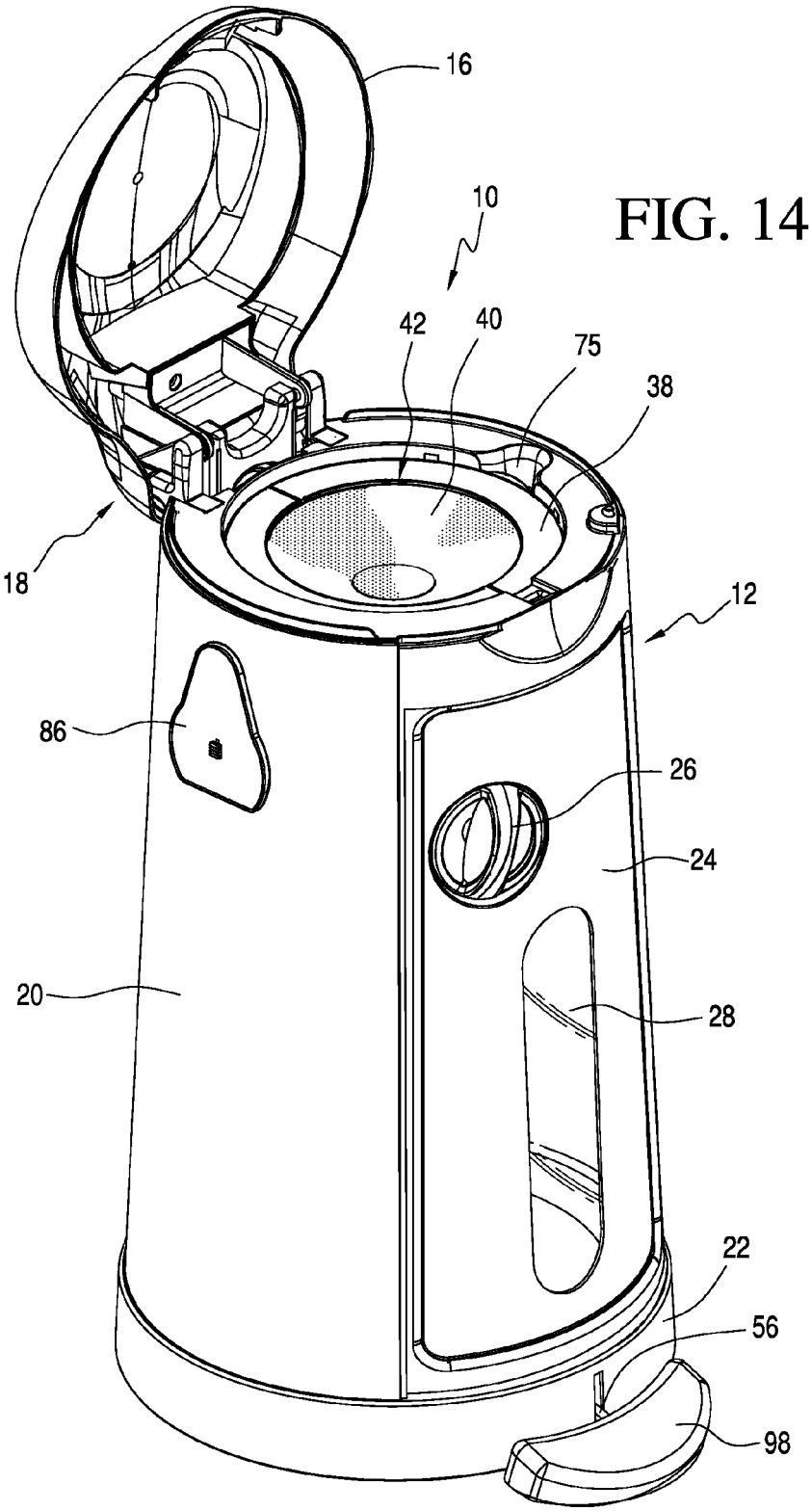
FIG. 14 is a perspective view of a second embodiment of a waste container in accordance with the invention shown with its lid in an open state, and including a first embodiment of an actuator and a foot pedal.

FIG. 14 shows another embodiment of a waste container in accordance with the invention. This embodiment includes a depressible pedal 98 that is coupled to the lid 16 and controls movement of the lid 16 between the closed position, and the open position shown in FIGS. 1 and 2. Pedal 98 may be a foot pedal having a first, undepressed (not shown) wherein it is slightly elevated from a plane defined by the lower surface of the base 12 to enable depression thereof. When depressed into the state shown in FIG. 14, the coupling between the foot pedal 98 and the lid 16 causes the lid 16 to open. When pressure on the foot pedal 98 is released, the lid 16 closes. This coupling between the foot pedal 98 and the lid 16 to convert depression of the foot pedal 98 into opening movement of the lid 16 may be any coupling used in containers known to those skilled in the art. A portion of this coupling mechanism 56, also referred to as coupling means herein, is shown at in FIG. 14, and includes a horizontal actuating member. The coupling mechanism may be as described in U.S. Pat. No. 8,393,489 (Stravitz) and other patents by the inventor herein as mentioned above, all of which are incorporated by reference herein.

An embodiment of a waste container in accordance with the invention may also include a conventional foot pedal, including a spring to retain the lid to the closed position after having been pivoted open by depressing the foot pedal. A spring to provide for this return movement with force, as described in patents by the inventor mentioned above, is not required. One reason is because the membrane 44 and the bag 40 do not rotate in order to cause a knot to form upon movement of the lid 16. Rather, the membrane 44 remains static and the actuator 86 connected to the obstruction member 84 will choke the bag 40 while the bag support 38 remains stationery. The tab 76 is not used to prevent rotation of the bag assembly 42, because there is no possible rotation thereof, but it is used for insertion and removal of the bag support 38 and bag 40. Conveniently, as noted above, the tab 76 and corresponding recess 75 are at about 90 degrees from the weakened part, i.e., hinges 74, of the bag support 38 so the bag support 38 folds almost perfectly in half.

Figure 15:
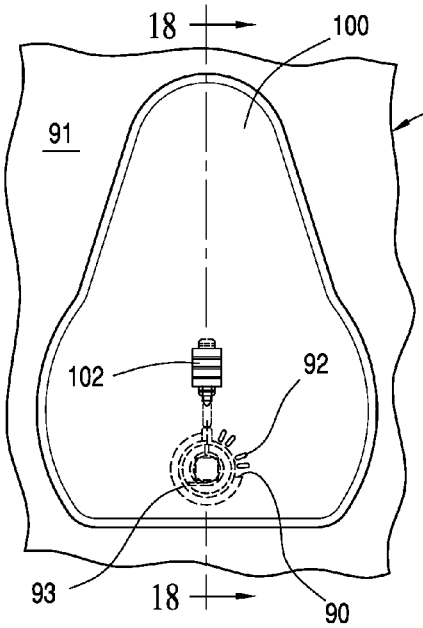
FIG. 15 is a front view of the first embodiment of the actuator for the waste container shown in FIG. 14 and its surrounding environment, in a first position.
Figure 16:
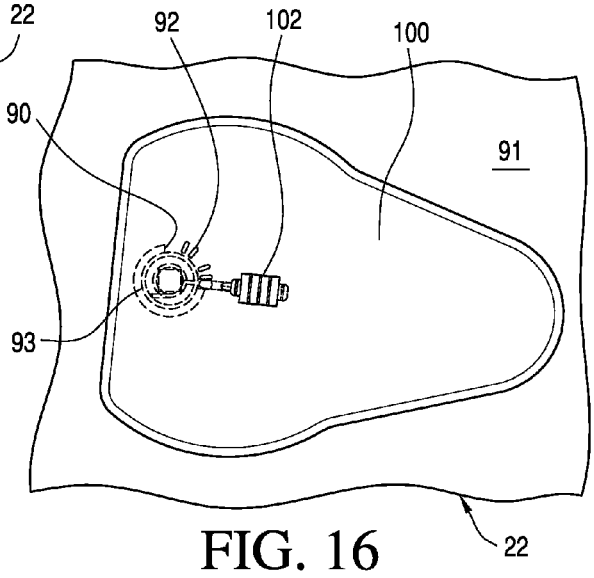
FIG. 16 is a front view of the first embodiment of the actuator of the waste container shown in FIG. 14 and its surrounding environment, in a second position.
Figure 17:
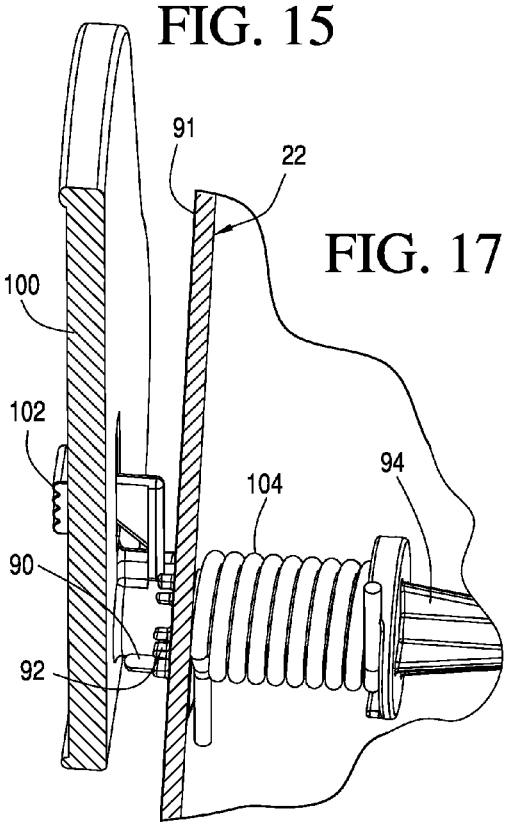
FIG. 17 is a cross-sectional view through the first embodiment of the actuator of the waste container shown in FIG. 14.
Figure 18:
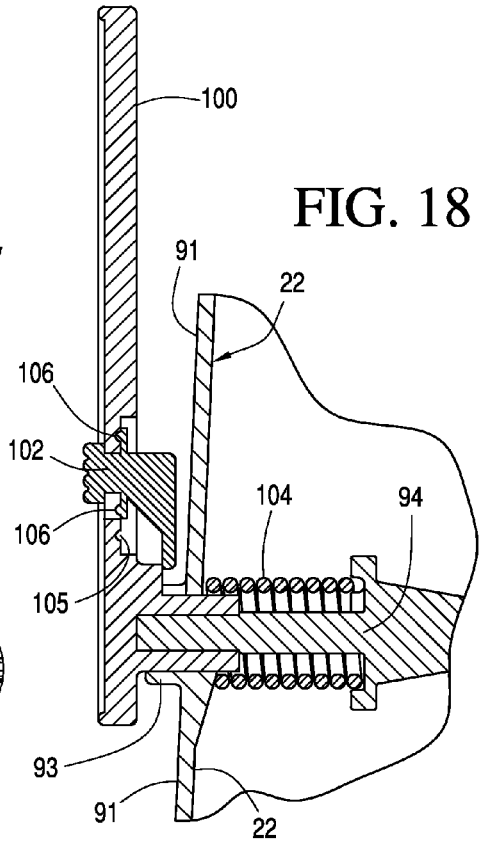
FIG. 18 is a cross-sectional view of the first embodiment of the actuator taken along the line 18-18 in FIG. 15.

FIGS. 15-18 show a second embodiment of an actuator and its coupling to the obstruction member. In this embodiment, the actuator 100 includes a switch 102 that is movable between a position in which it will engage the click stops 92 on the side wall 20 of the base 12 and a position in which it is not in contact with the click stops 92. One purpose of the two-position switch 102 is to allow for easier movement of the actuator 100 from the horizontal position (FIG. 16) to the vertical position (FIG. 15).

When the switch 102 is in the down position, it engages the click stops 92, the purpose of which is described above. Once the actuator 100 reaches the rotation limiting stop 90, i.e., it has reached and past the horizontal position (i.e., at an angle of about 110 degrees to the right from the vertical position shown in FIG. 16, the switch 102 is moved to the up position causing disengagement of the switch 102 from the click stops 102 and allowing the actuator 100 to be quickly rotated back to the vertical position shown in FIG. 15 by virtue of a torsion spring 104 arranged on the shaft 94 (see FIGS. 18 and 19). Spring 104 is mounted with one end on the shaft 94 and with its other end on the actuator 102 (see FIG. 18). Thus, rotation of the actuator 102 from the vertical position past the horizontal position is against the bias of the spring 104, and when there is no impediment to reverse rotation of the actuator 100, the actuator 100 is reverse rotated by the release of the force in the spring 104. The rear surface of the actuator 100 is provided with recesses 105 that receive projections 106 on the switch 102 to retain the switch in the two positions (see FIG. 18).

The spring 104 when the switch 102 is up (disengaged) will return (spring back) to the starting position upon releasing the switch 102. Depending upon the tension and strength of the spring 104, the switch 102 may return back to its initial position faster or slower automatically. For example: from the post-actuated position or partially actuated position with the switch 102 engaging the click stops 92, by lifting the switch 102 to the vertical position, thus disengaging the click stops 92, the actuator 100 will automatically return to position one due to the torsion spring 104 returning to its un-stressed state. The torsion spring 104 is trapped in two places, i.e., to the shaft 94 and to the side wall 20 of the base 12 (see FIG. 18), and thus either in the relaxed state or under tension. It can be in a tensed condition when you rotate the actuator 100 by hand and hold it, or it can stay tensed when engaged in any one of the click stops 92.

Figure 19:
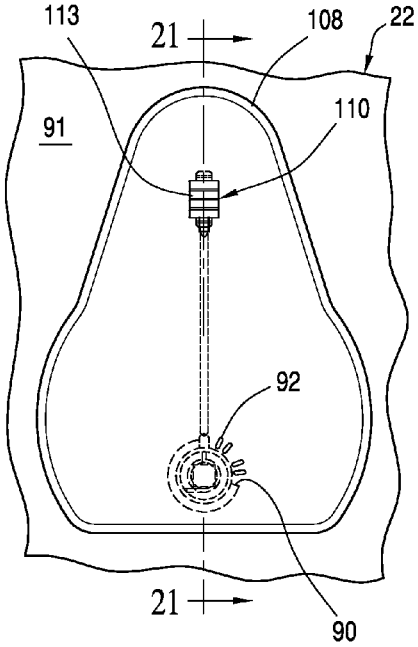
FIG. 19 is a front view of a second embodiment of an actuator for the waste container shown in FIG. 14 and its surrounding environment, in a first position.
Figure 20:
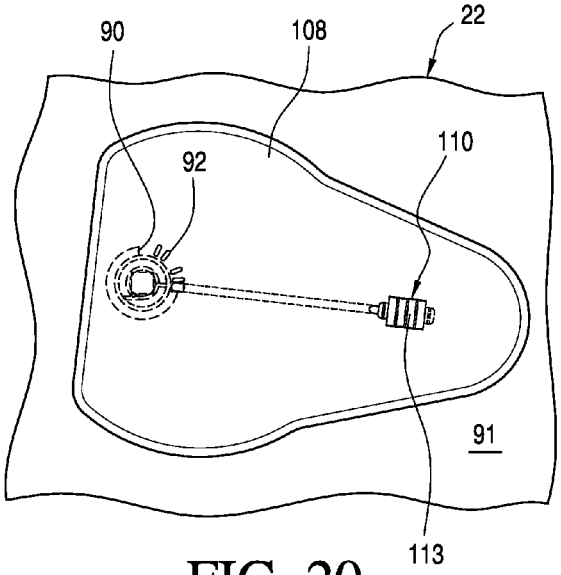
FIG. 20 is a front view of the second embodiment of the actuator for the waste container shown in FIG. 14 and its surrounding environment, in a second position.
Figure 21:
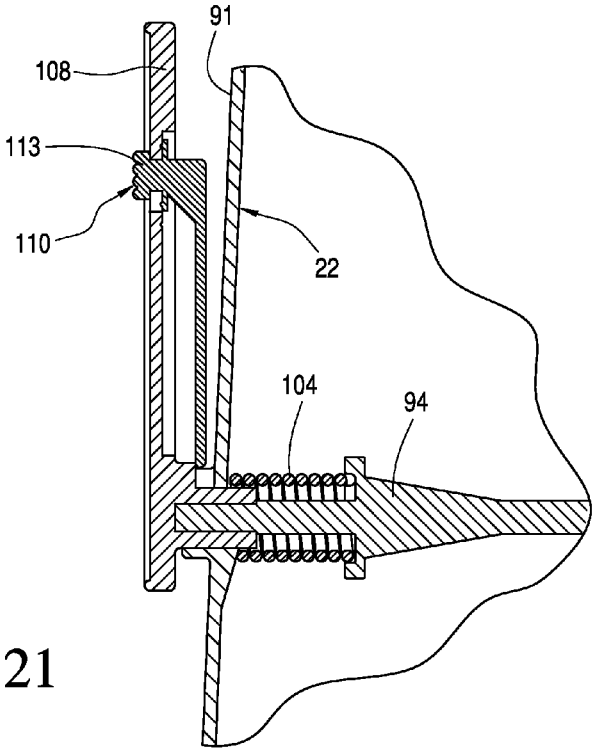
FIG. 21 is a cross-sectional view of the second embodiment taken along the line 21-21 in FIG. 19.

FIGS. 19-21 show a third embodiment of an actuator 108 and its coupling to the obstruction member 84. In this embodiment, the actuator 108 includes a switch 110 that is movable between a position in which it will engage the click stops 92 on the side wall 20 of the base 12 and a position in which it is not in contact with the click stops 92. Switch 110 is longer than switch 102 and extends further up the actuator 108 and thus includes a longer connecting portion 112 between the manually accessible part 113 and the click stops 92 (see FIG. 21). An advantage of the longer connecting portion 112 is the more convenient switch operation since a user can hold the actuator 108 and switch 110 with three fingers more conveniently (e.g., the thumb and middle finger on the actuator 108 and the index finger on the switch 110) and thereby manipulate the actuator 108 and switch 110 with one hand more easily than in the embodiment shown in FIGS. 15-18 (wherein reaching down for the switch 110 while holding the actuator 108 can be problematic).

FIGS. 22-27 show various forms of the obstruction member used in a waste container in accordance with the invention. Generally, the obstruction member provides one or two solid parts that contact the bag so that when the obstruction member is rotatable between two different extreme positions, in one of which the solid parts obstruct the passage defined by the bag to thereby close and seal the bag preventing escape of odor from the interior (a choke position) and in other of which the passage is open thereby allowing for insertion of waste into the bag interior. When the obstruction member includes two solid parts, the bag passes between them (see FIGS. 22-26) and when there is only a single solid part, the bag passes alongside the solid part (see FIG. 27). As described above, there are various ways to rotate the obstruction member between the two extreme positions.

Figure 22:
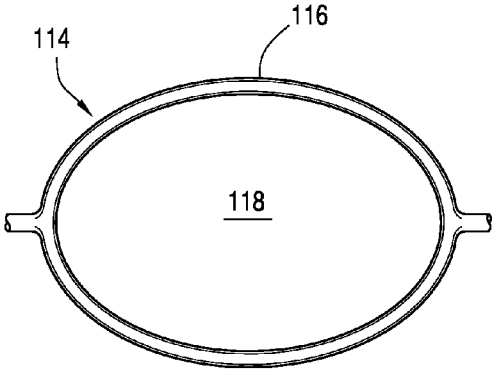
FIG. 22 is a top view of a second embodiment of an obstruction member for the waste containers in accordance with the invention.

FIG. 22 shows an obstruction member 114 with an oval-shaped portion 116, with the bag being placed through the aperture 118 defined by the oval portion 116 of the obstruction member 114.

Figure 23:
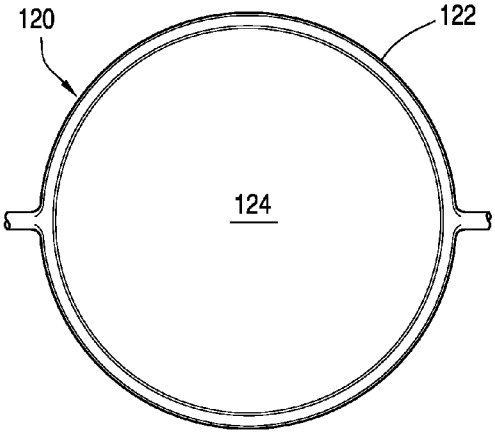
FIG. 23 is a top view of a third embodiment of an obstruction member for the waste containers in accordance with the invention.

FIG. 23 is an enlarged view of the obstruction member 120 with a circular-shaped portion 122 defining a circular aperture 124 of the waste container shown in FIG. 1.

Figure 24:
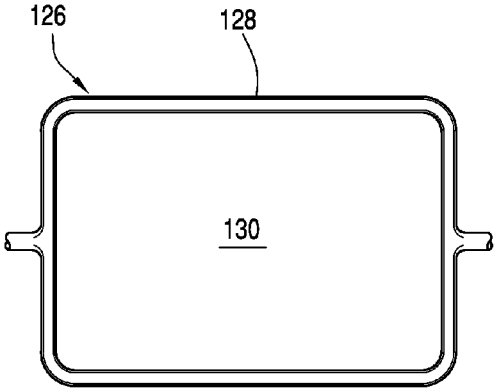
FIG. 24 is a top view of a fourth embodiment of an obstruction member for the waste containers in accordance with the invention.

FIG. 24 shows an obstruction member 126 with a rectangular-shaped portion 128, with the bag being placed through an aperture 130 defined by the rectangular portion 128 of the obstruction member 126.

Figure 25:
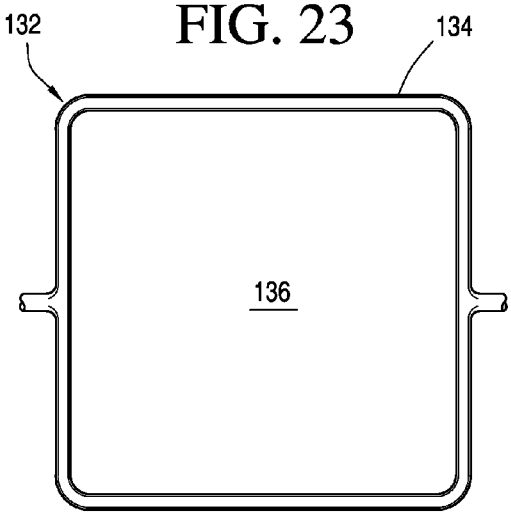
FIG. 25 is a top view of a fifth embodiment of an obstruction member for the waste containers in accordance with the invention.

FIG. 25 shows an obstruction member 132 with a square-shaped portion 134, with the bag being placed through an aperture 136 defined by the square portion 134 of the obstruction member 132.

Figure 26:
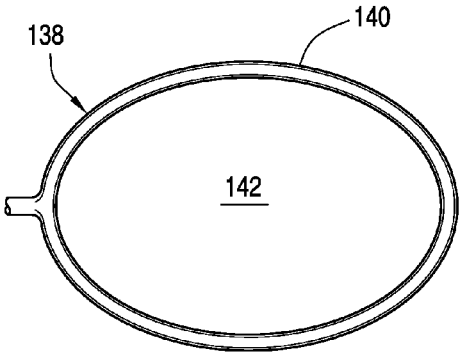
FIG. 26 is a top view of a sixth embodiment of an obstruction member for the waste containers in accordance with the invention.

FIG. 26 shows an obstruction member 138 with an oval-shaped portion 140, with the bag being placed through an aperture 142 defined by the portion 140. However, in this embodiment, the obstruction member 138 is retained on the side wall 20 of the waste container 10 only at the end proximate the actuator 86. There is no retaining structure at the opposite end of the obstruction member 138. In a similar manner, an obstruction member can be formed with a circular portion, rectangular portion or square portion and only retained at one end of the waste container 10.

Figure 27:
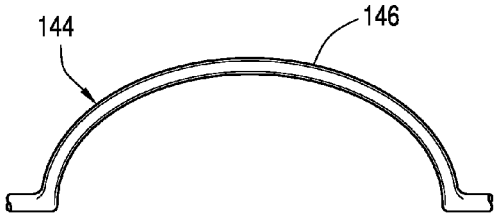
FIG. 27 is a top view of a seventh embodiment of an obstruction member for the waste containers in accordance with the invention.

FIG. 27 shows an obstruction member 144 with a C-shaped portion 146, but which is retained at both ends on the side wall 20 of the waste container 10. Such an obstruction member 144 will engage the bag that passes alongside the C-shaped portion 146 at only one place, but is still effective as an obstruction member to perform in the manner described above. In a similar manner, an obstruction member can be formed with a semi-circular portion, semi-rectangular portion or semi-square portion and retained at both ends of the waste container.

Figure 28:
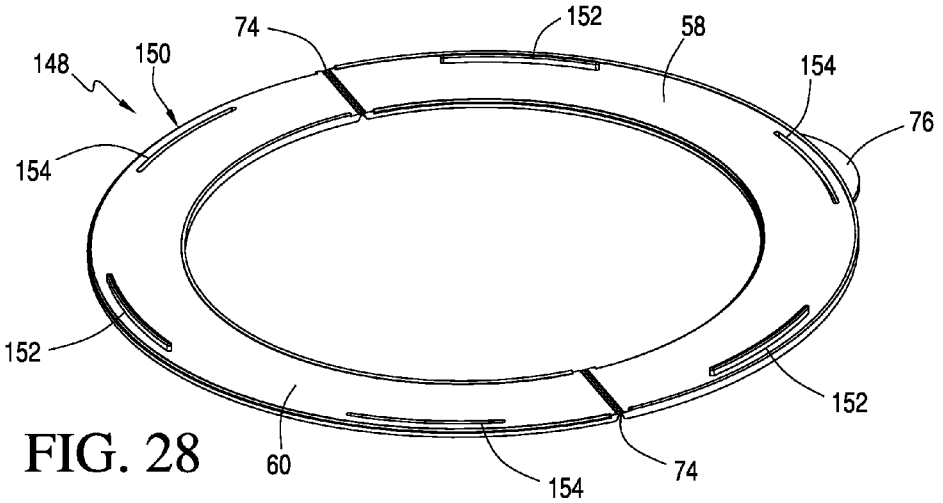
FIG. 28 is a perspective view of a second embodiment of a foldable support for a flexible bag used with waste containers in accordance with the invention.
Figure 29:
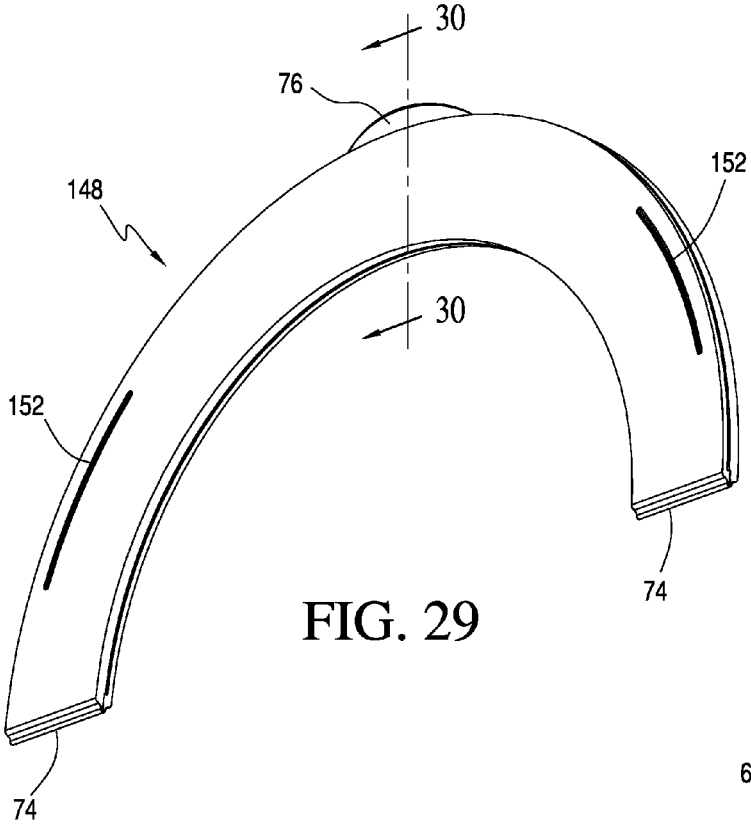
FIG. 29 is a perspective view of the second embodiment of the foldable support for a flexible bag in a folded state.
Figure 30:
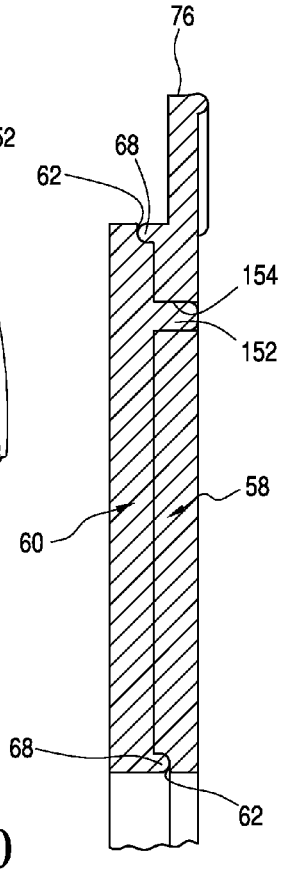
FIG. 30 is a cross-sectional view of the second embodiment of the foldable support for a flexible bag taken along the line 30-30 in FIG. 29.

Referring now to FIGS. 28-30, this embodiment of a foldable support 148 for a flexible bag is similar to that shown in FIGS. 6-9, with the addition of a supplemental engagement system 150. This supplemental engagement system 150 is additional to the cooperating male and female connection elements 62, 68 on the peripheral edges of the tabbed portion 58 and non-tabbed portion 60 of the support 148. It thus serves to assist the cooperating male/female connection elements 62, 68 in maintaining the support portions 58, 60 together when in the folded state shown in FIG. 29. Moreover, the supplemental engagement system 150 does not interfere with the placement and use of the bag assembly 42 including the foldable support 148 when used in the waste containers disclosed herein.

The supplemental engagement system 150 includes one or more preferably a plurality of arcuate projections or ribs 152 and corresponding arcuate aperture(s) 154 on the tabbed and non-tabbed portions 58, 60 of the support 148, with the projections and apertures 152, 154 being positioned to engage with and snap into one another to thereby generate a press-fit when the support 148 is in the closed state (see FIG. 30). In the illustrated embodiment, the tabbed portion 58 of the support 148 includes an arcuate aperture 154 behind the tab 156, and two arcuate projections 152, one on each side of the aperture 154 (see FIG. 28). As such, the non-tabbed portion 60 includes an arcuate projection 152 at a central area, and one arcuate aperture 154 on each side (see FIG. 28). However, the tabbed portion 58 may include only one type of connector, e.g., projections, while the non-tabbed portion 60 includes only the other type of connector, e.g., apertures. Various combinations of projections and apertures may also be provided.

Although three cooperating projections/apertures 152, 154 are shown in FIG. 28, any number of cooperating projections/apertures 152, 154 may be provided. Also, the projections and apertures must have a complementary form, e.g., arcuate as shown, but this form may vary, e.g., linear apertures and projections may be used if desired. Moreover, different forms of projections/apertures 152, 154 may be used in the same embodiment, e.g., one arcuate projection/aperture and one linear projection/aperture.

Each projection 152 is formed to extend slightly above the planar upper surface of the respective portion of the support 148 to provide the projection with concentric inner and outer walls and radially oriented end walls (see FIG. 28). Each aperture 154 is defined by concentric arcuate surfaces and radially oriented end surfaces.

Figure 31:
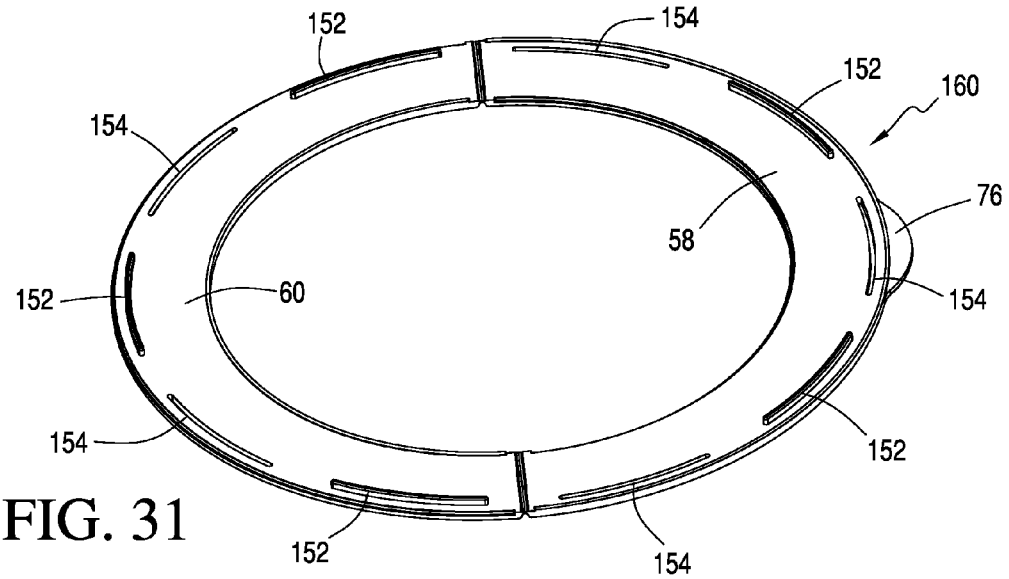
FIG. 31 is a perspective view of a third embodiment of a foldable support for a flexible bag used with waste containers in accordance with the invention.
Figure 32:
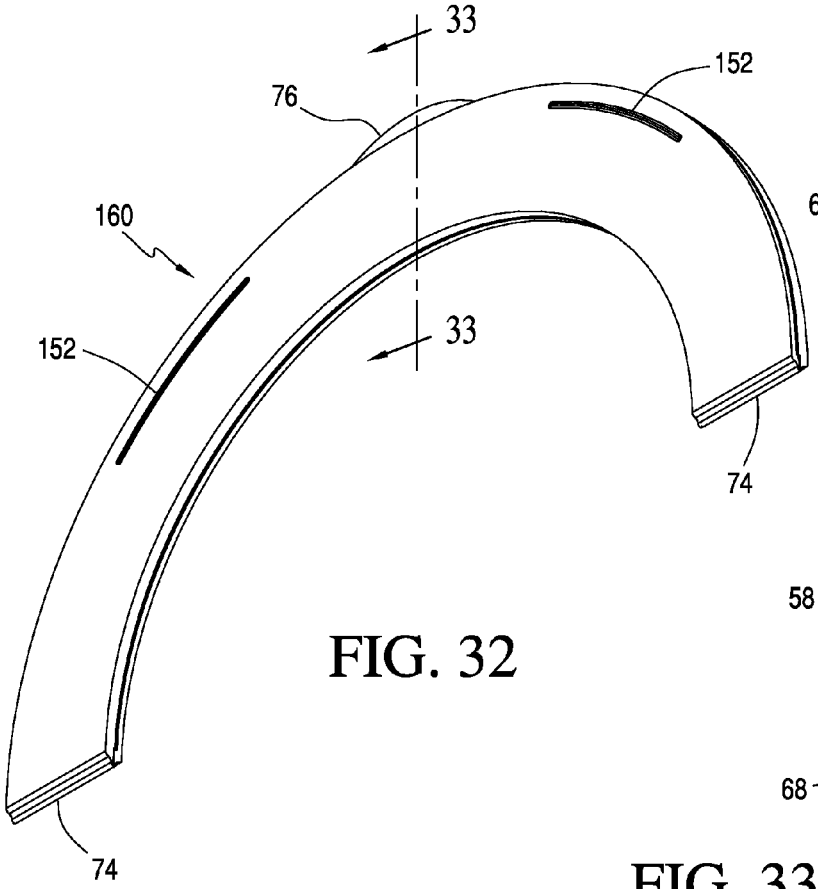
FIG. 32 is a perspective view of the third embodiment of the foldable support for a flexible bag in a folded state.
Figure 33:
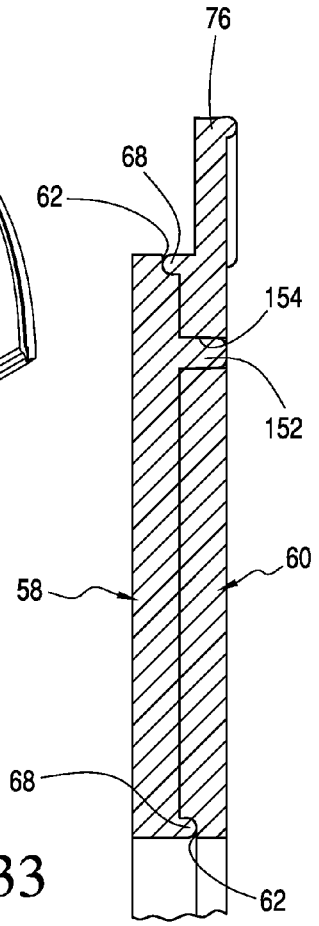
FIG. 33 is a cross-sectional view of the third embodiment of the foldable support for a flexible bag taken along the line 33-33 in FIG. 32.

Referring now to FIGS. 31-33, this embodiment of a foldable support 160 for a flexible bag is similar to that shown in FIGS. 28-30, and shows that each of the tabbed portion 58 and non-tabbed portion 60 includes five connectors. Specifically, the tabbed portion 58 includes two projections 152 and three apertures 154 in an alternating arrangement while the non-tabbed portion 60 includes three projections 152 and two apertures 154 in an alternating arrangement.

It should be understood that the male and female connection elements on the peripheral edges of the tabbed portion 58 and non-tabbed portion 60 of the supports 148, 160 may be different from that shown in FIGS. 28-33. Thus, these embodiments should be considered to generally include a primary engagement system of male and female connection elements 62, 68, one of which is arranged on each of the peripheral edges of the tabbed portion 58 and the complementary one being arranged on the opposite peripheral edges of the non-tabbed portion 60.

Figure 34:
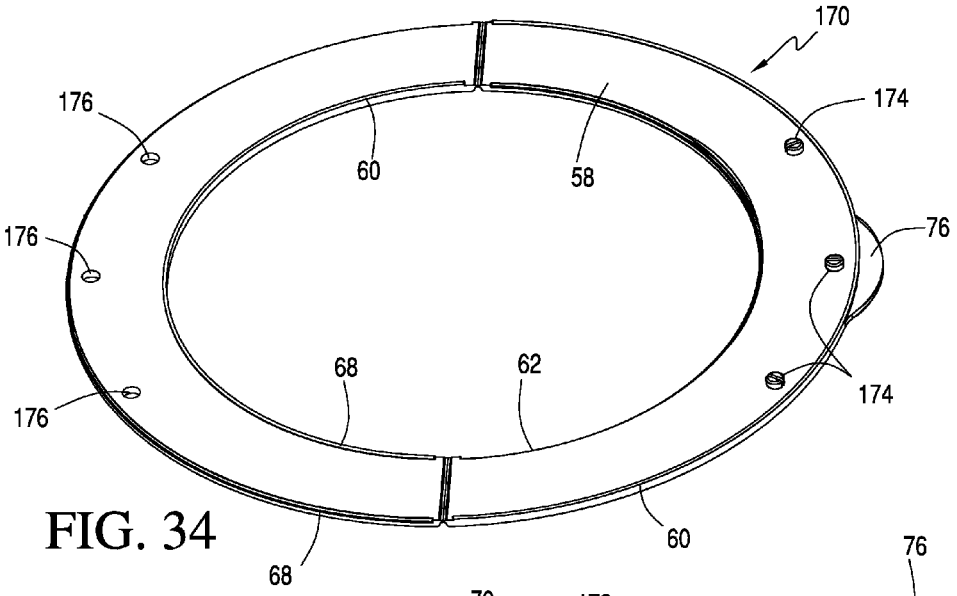
FIG. 34 is a perspective view of a third embodiment of a foldable support for a flexible bag used with waste containers in accordance with the invention.
Figure 35:
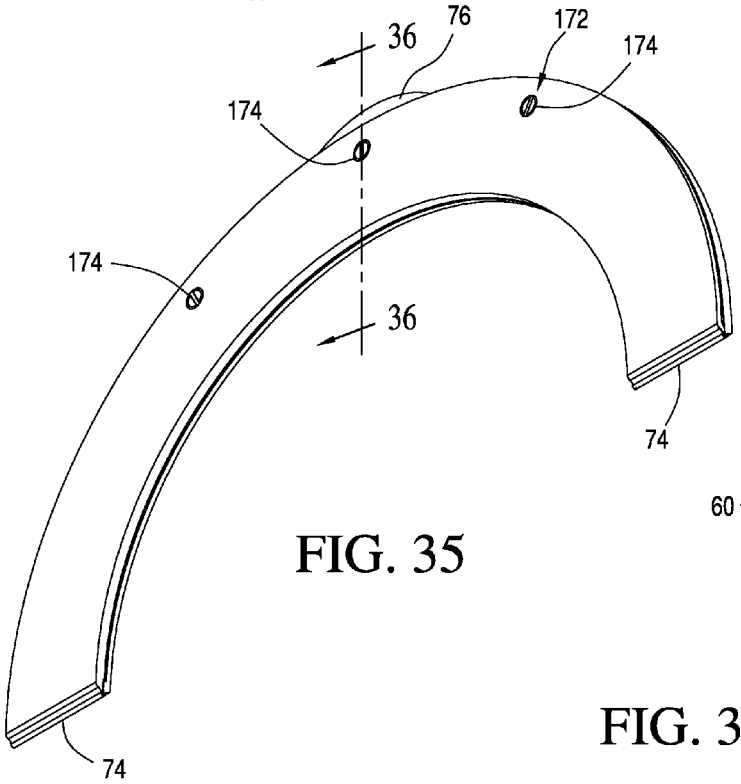
FIG. 35 is a perspective view of the fourth embodiment of the foldable support for a flexible bag in a folded state.
Figure 36:
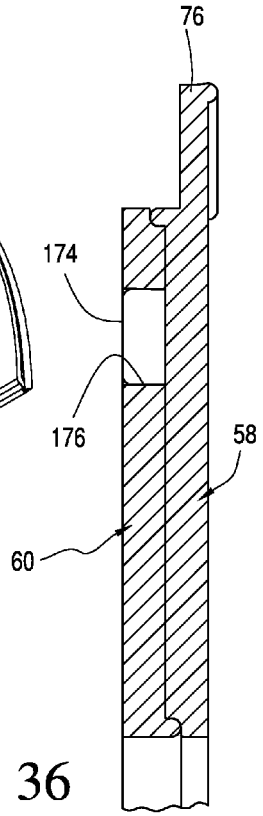
FIG. 36 is a cross-sectional view of the fourth embodiment of the foldable support for a flexible bag taken along the line 36-36 in FIG. 35.

Referring now to FIGS. 34-36, this embodiment of a foldable support 170 for a flexible bag is similar to that shown in FIGS. 6-9, with the addition of a supplemental engagement system 172. This supplemental engagement system 172 assists the cooperating male/female connection elements 62, 68 in maintaining the support portions 58, 60 together.

The supplemental engagement system 172 includes a boss or projection 174 on the tabbed portion 58 of the support 170 and receptacles 176 on the non-tabbed portion 60 of the support 170 that each receive a respective one of the bosses 174. Although three bosses 174 and receiving receptacles 176 are shown in FIG. 34, any number of bosses and receiving receptacles may be provided. Also, the bosses 174 may include one boss behind the tab 178, e.g., centrally located between the lateral edges of the tabbed portion 58 of the support 170. One boss is then located on each side of this centrally located boss.

Each boss 174 is formed from two semi-cylindrical halves, both of which have rounded outer corners to facilitate insertion into the cooperating aperture (as best seen in FIGS. 35 and 36). By splitting the boss 174 into two halves, a degree of flexibility is provided to each boss half, i.e., each boss half can flex inward when inserted into the aperture, and this forced inward flexing generates a press fit when the boss 174 is surrounded by the surface of the tabbed portion of the support defining the aperture.

Alternatively, each boss 174 may be a solid structure with rounded outer corners to facilitate insertion into the cooperating aperture.

Figure 37:
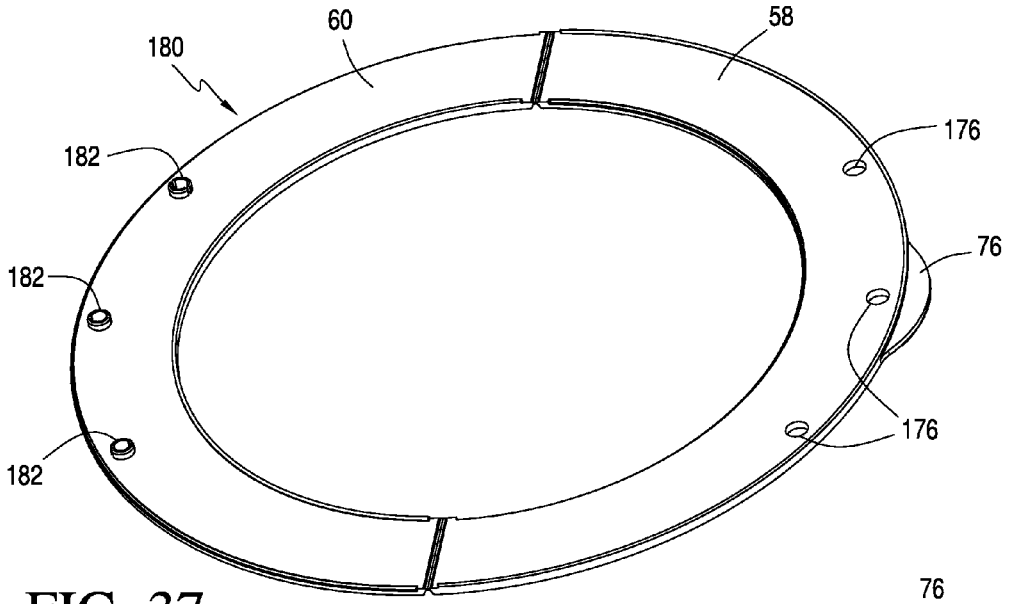
FIG. 37 is a perspective top view of a fifth embodiment of a foldable support for a flexible bag used with waste containers in accordance with the invention.
Figure 38:
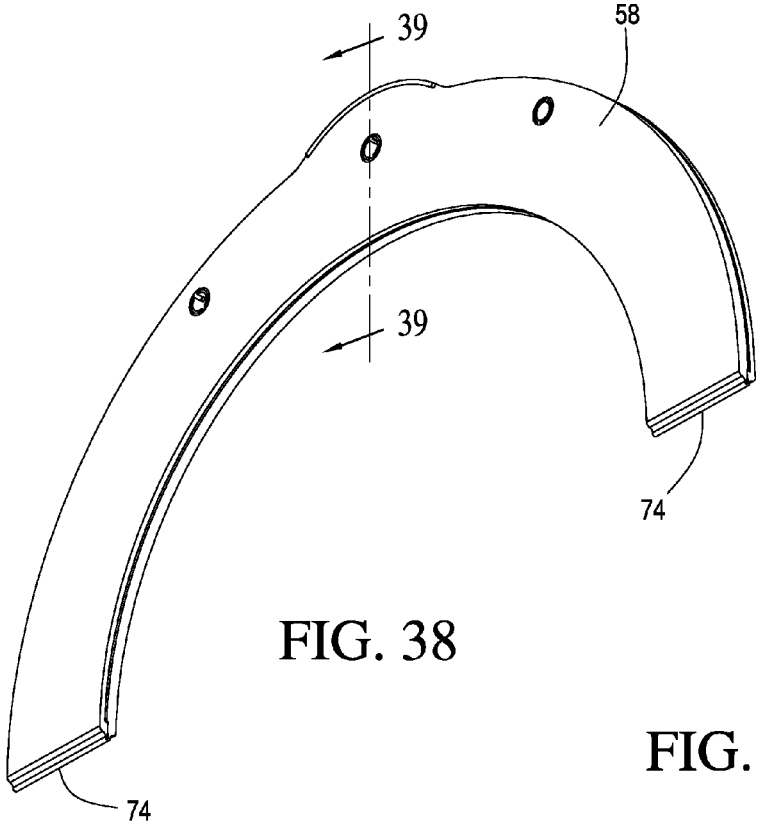
FIG. 38 is a perspective view of the fifth embodiment of the foldable support for a flexible bag in a folded state.
Figure 39:
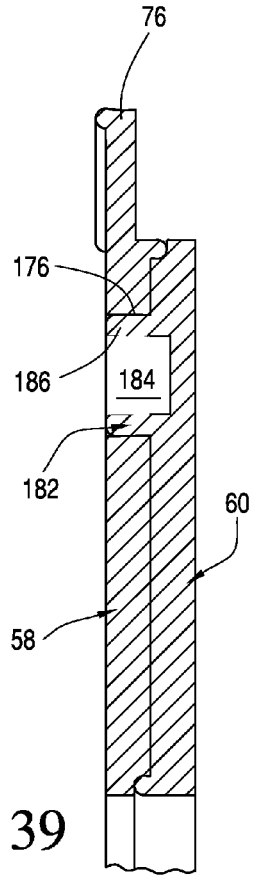
FIG. 39 is a cross-sectional view of the fifth embodiment of the foldable support for a flexible bag taken along the line 39-39 in FIG. 38.

Referring now to FIGS. 37-39, this embodiment of a foldable support 180 for a flexible bag is similar to that shown in FIGS. 34-36, with the exception that the bosses 182 are hollowed out. That is, each boss 182 is not a solid cylindrical projection but rather includes a cylindrical cavity 184 surrounding by a peripheral wall 186 that defines the outer surface of the boss 182 (see FIG. 39). The hollowing out of the boss 182 serves a similar purpose as the slit between the boss halves in the embodiment of FIGS. 34-36, i.e., it provide a degree of flexibility to the boss 182 so that the boss 182 can flex inward when inserted into the receptacle 176, and this forced inward flexing generates a press fit when the boss 182 is surrounded by the surface of the tabbed portion 58 of the support 180 defining the receptacle 176.

It should be understood that the male and female connection elements 62, 68 on the peripheral edges of the tabbed portion 58 and non-tabbed portion 60 of the supports 170, 180 may be different from that shown in FIGS. 34-39. Thus, these embodiments should be considered to generally include a primary engagement system of male and female connection elements, one of which is arranged on each of the peripheral edges of the tabbed portion and the complementary one being arranged on the opposite peripheral edges of the non-tabbed portion. Moreover, it is possible that only one male connection element 62 is provide on the tabbed or non-tabbed portion 58, 60 and one female connection element 68 on the other of the tabbed or non-tabbed portion 58, 60, since the bosses and cooperating apertures may suffice to generate adequate retention force to keep the support portions together in the folded state shown in FIGS. 35 and 38.

Figure 40:
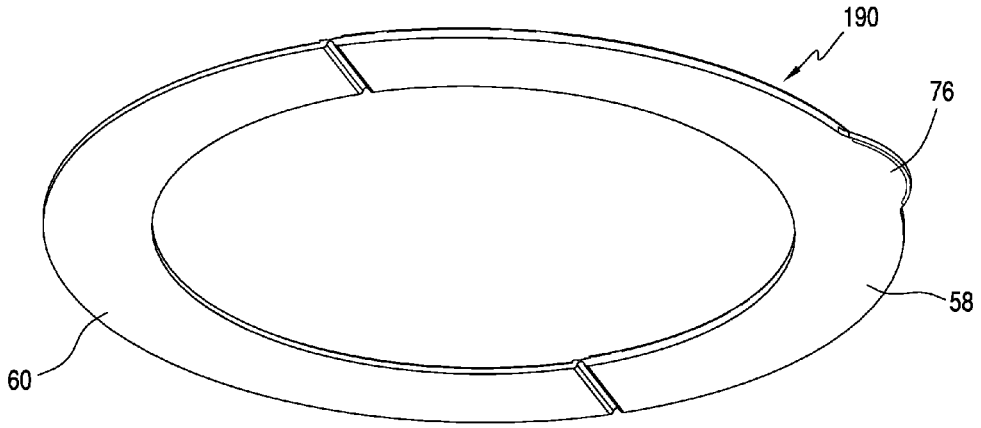
FIG. 40 is a perspective bottom view of a sixth embodiment of a foldable support for a flexible bag used with waste containers in accordance with the invention.
Figure 41:
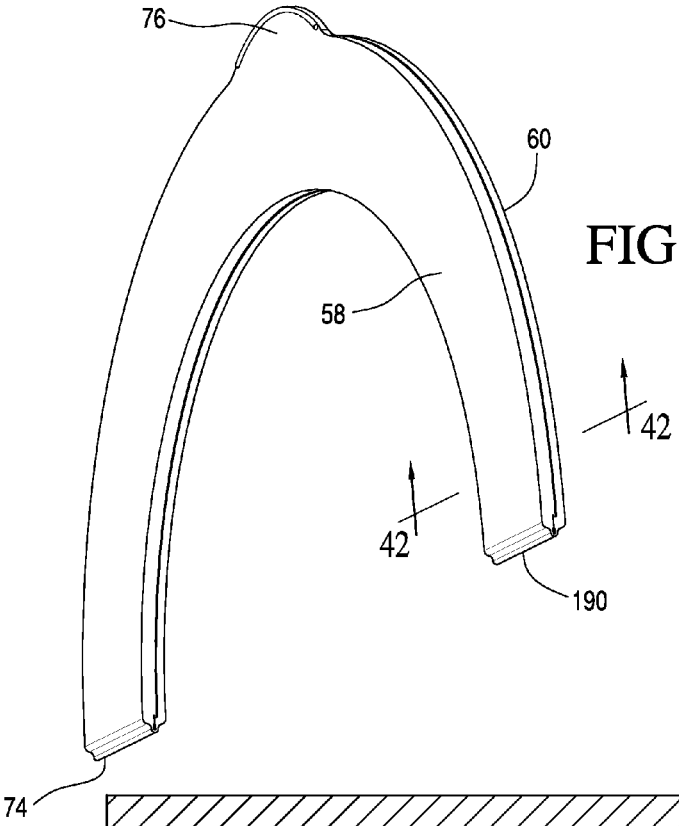
FIG. 41 is a perspective view of the sixth embodiment of the foldable support for a flexible bag in a folded state.
Figure 42:
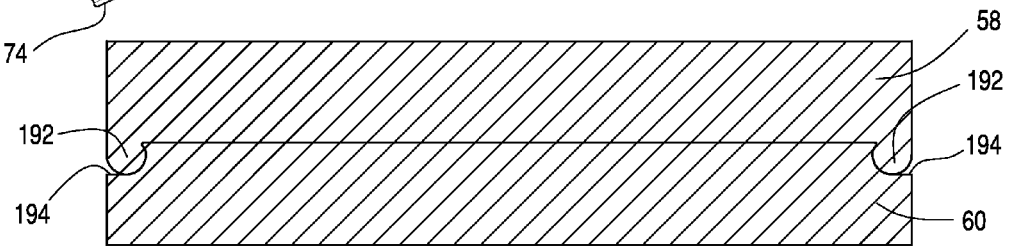
FIG. 42 is a cross-sectional view of the sixth embodiment of the foldable support for a flexible bag taken along the line 42-42 in FIG. 41.

Referring now to FIGS. 40-42, in this embodiment of a foldable support 190 for a flexible bag, the tabbed portion 58 of the support 190 includes two male connection elements 192, one on each of the inner and outer peripheral edges, and the non-tabbed portion of the support includes two female connection elements 194, one on each of the inner and outer peripheral edges (see in particular FIG. 42). The male connection elements 192 snap into engagement with the female connection elements 194 when the support portions 58, 60 are pivoted about the hinge from the use state shown in FIG. 40 to thereby enable the support 190 to be brought into and maintained in the folded state shown in FIG. 41. Otherwise, the construction and use of the support is similar to or the same as the construction and use of the other supports described elsewhere herein.

The containers described above are not limited to use for any particular type of waste. The containers may be used for cat litter, diapers for children or adults, kitchen products, bathroom waste, medical waste, general waste and the like.

For medical use, it is possible to use the container in a hands-free mode whereby the user with medical waste uses their foot to open the lid 16 by depressing the foot pedal and then drops the medical waste into the bag aperture 40A or along the portion of the bag 40 that overlies the funnel-shaped membrane 44. By the effect of gravity, the waste falls through the bag aperture 40A into the portion of the bag 40 in the compartment 14. For bio-hazardous waste, a red-colored bag 40 may be used. The lid 16 remains open as long as the user keeps their foot on the foot pedal. When pressure on the foot pedal 98 is released, the lid 16 closes.

Moreover, the various embodiments of the foldable bag support 38 for a bag assembly 42, e.g., those shown in FIG. 28-42, may be used with any other waste container that is capable of receiving a bag assembly. The foldable bag support 38 could also be used with a different bag assembly than disclosed herein. Thus, the various embodiments of the foldable bag support 38 are considered separate and independent inventions, and the various embodiments of the foldable bag support 38 when incorporated into a bag assembly 42 as disclosed herein are also considered separate and independent inventions.

Figure 43:
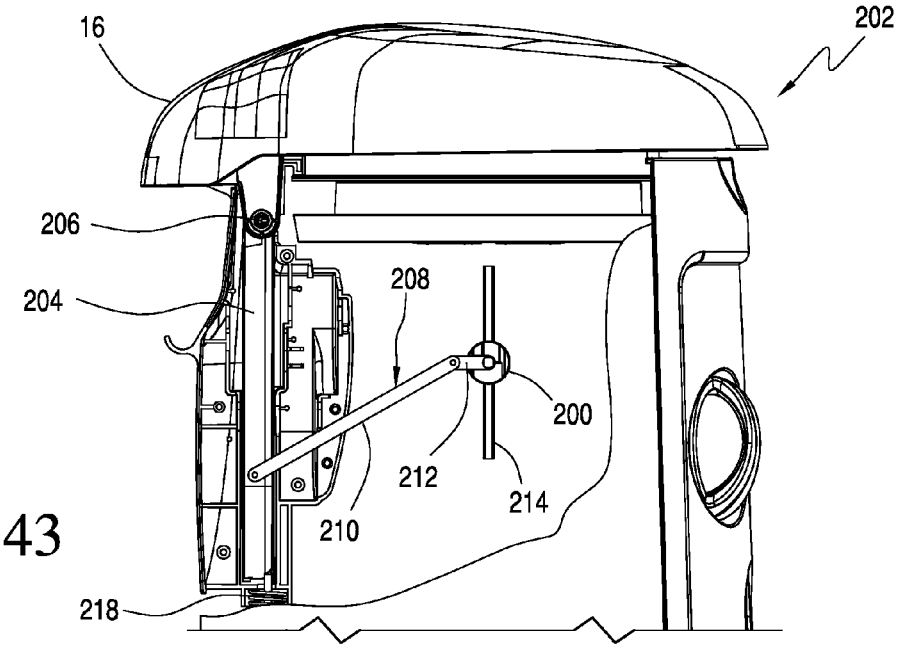
FIG. 43 is a side view, partly broken away, of another embodiment of a waste container in accordance with the invention showing the obstruction member in an obstructing position.
Figure 44:
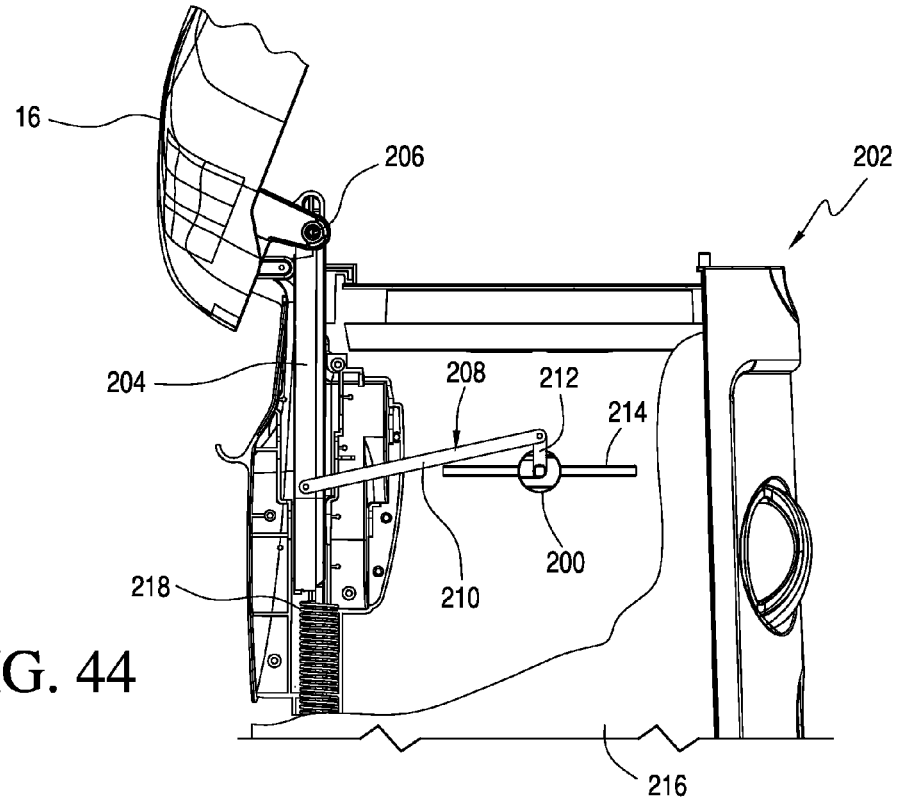
FIG. 44 is a side view, partly broken away, of the embodiment of the waste container shown in FIG. 43 with the obstruction member in a non-obstructing position.

Referring finally to FIGS. 43 and 44, another embodiment of a waste container in accordance with the invention is disclosed and includes a mechanism that couples movement of the lid 16 to the rotation of an obstruction member 200. That is, when the lid 16 is closed, the obstruction member 200 is automatically moved from one position in which the bag channel is open to the position in which the bag channel is closed, this automatic movement being effected without manual intervention to cause the rotation of the obstruction member 200. On the other hand, when the lid 16 is opened, the obstruction member 200 is automatically moved from one position in which the bag channel is closed to the position in which the bag channel is open to enable insertion of waste, this automatic movement also being effected without manual intervention to cause the rotation of the obstruction member 200.

Waste container 202 includes a member 204 connected to the lid 16 and that moves upward when the lid 16 is opened and downward when the lid 16 is closed. Member 204 may be an elongate rod associated with the mechanism that enables the lid 16 to pivot, or simply a rigid bar connected at a pivot point 206 to the lid 16. Member 204 may be arranged anywhere along the lid assembly, including attached to the lid 16 as shown. Alternatively, member 204 may be a U-shaped component as disclosed in the inventor's other patents and patent applications mentioned above.

Member 204 is connected at an opposite end region or at an intermediate region to an actuating mechanism or linkage 208 including an elongate, rigid link or rod 210 and an elongate link or arm 212 attached to the obstruction member 200. Instead of a rod 210 and arm 212, other mechanisms and structure of converting vertical movement of the member 204 into rotational movement of the obstruction member 200 are considered to be within the scope of the invention. Such mechanisms and structure are referred to as a means for converting linear movement into rotational movement.

For example, in an alternative embodiment, the arm 212 is replaced by a lever that is connected at one end region to the shaft to which the obstruction member 200 is integrated, and at an opposite end region is attached to the rod 210. The lever may have a variable shape, from a larger width proximate the shaft attachment end region to a smaller width proximate the rod attachment end region, and being generally planar and extending in a plane perpendicular to the axis of the shaft from which it extends. The attachment of the rod 210 to the lever may be a temporary attachment, i.e., the rod 210 could be selectively engaged and disengaged from the lever. The attachment of the rod 210 to the member 204 may also be a temporary attachment, i.e., the rod 210 could be selectively engaged and disengaged from the member 204.

For this embodiment, as well as the embodiment illustrated in FIGS. 43 and 44, the automatic obstruction member rotation mechanism may be additive to the manual obstruction member rotation mechanism. That is, the obstruction member may be rotated either automatically or manually when the rod is in place, or only manually by rotating the actuator when the rod is removed. Thus, FIGS. 43 and 44 do not show the manual actuator in view of these drawings being partially broken away, but the obstruction member of any of the embodiments described above may be present. Similarly, the automatic obstruction member rotation mechanism may be provided in combination with any of the manual obstruction member rotation mechanisms and configurations described above.

The obstruction member 200 is constructed generally as described above, i.e., including a portion 214 defining an aperture and a support structure for supporting this portion on the side wall 216 of the container 202. The support structure may support the aperture-defining portion 214 on one or both sides of the side wall 216. In one embodiment, the arm 212 is attached to the shaft of the obstruction member 200.

When the lid 16 is in a closed position shown in FIG. 43, the portion 214 obstructs the bag channel in the bag (not shown, but see FIG. 13). Opening of the lid 16 automatically causes rotation of the obstruction member 200 to the position shown in FIG. 44 wherein the bag channel is not obstructed and waste can be inserted into the bag (not shown). That is, it is not necessary for the user to manipulate an actuator after opening the lid, as in the embodiments described above, in order to effect rotation of the obstruction member.

Opening of the lid 16 may be undertaken manually, by means of a foot pedal (see the embodiment shown in FIG. 14), or by any other lid opening mechanism or structure known to those skilled in the waste container filed. This opening movement automatically causes rotation of the obstruction member 200. Closure of the lid 16 may also be effected manually, by release of pressure on a foot pedal, by means of a spring 218, or by any other lid closure mechanism used for a waste container. For example, this spring 218 may be a compression spring that is expanded when the lid 16 is opened (see FIG. 44) and when the opening force causing the lid 16 to open is removed, the spring 218 compresses and causes closure of the lid 16 (see FIG. 43). The opposite situation is also possible. Coupling actuation and release of a foot pedal to opening and closing movement of a lid is known in the art and all such mechanism, including those disclosed in the patent applications mentioned above and incorporated by reference herein, are considered part of the invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A waste container, comprising:

a base defining a waste-receiving compartment;

a lid movably attached to said base and movable between a first position covering a waste insertion opening and a second position in which it does not obstruct the waste insertion opening;

a support portion including an aperture through which a bag is placed into said compartment; and an obstruction mechanism having an actuator and an obstruction member having at least one part that selectively engages with the bag at a location below said support portion, said actuator being manually rotatable to cause movement of said obstruction member between a first position in which said obstruction member is in a first plane not obstructing insertion of waste into the bag and a second position in which said obstruction member is in a second plane pressing the bag and obstructing insertion of waste into the bag, said second plane being different than said first plane and intersecting said first plane at an angle.

2. The waste container of claim 1, wherein said actuator is configured to rotate said obstruction member about an axis perpendicular to a vertical axis of said base.

3. The waste container of claim 1, wherein said obstruction member is connected at only one end to said actuator and has an opposite, free end.

4. The waste container of claim 1, wherein said obstruction member is connected at one end to said actuator and at an opposite end to said base.

5. The waste container of claim 1, wherein said obstruction member defines a circular, oval-shaped, rectangular or square-shaped aperture adapted to surround the bag when present, such that said obstruction member has two parts that selectively engage with the bag, when present, below said support portion.

6. The waste container of claim 1, wherein said obstruction member defines a semi-circular portion, semi-rectangular portion or semi-square portion adapted to be situated alongside the bag when present, such that said obstruction member has only a single part that selectively engages with the bag, when present, below said support portion.

7. The waste container of claim 1, further comprising:

a membrane support arranged on said support portion including a membrane; and a bag assembly arranged on said membrane support, said bag assembly including the bag that passes through an opening defined by said membrane.

8. The waste container of claim 1, wherein said base has a vertical axis and is configured to retain the bag when present at an upper end such that the bag thus extends vertically in said waste-receiving compartment, said obstruction member being configured to rotate about a horizontal axis perpendicular to said vertical axis of said base.

9. The waste container of claim 1, wherein said actuator includes a rotating rib on a rear side, said base including a side wall with click stops that interact with said rib to control rotation of said actuator and thus movement of said obstruction member.

10. The waste container of claim 9, wherein said actuator further includes rotation limiting stops to limit rotation of said actuator.

11. The waste container of claim 9, wherein said obstruction mechanism further comprises a manually actuated switch movable between a position in which it can engage said click stops and a position in which it cannot contact said click stops.

12. The waste container of claim 11, wherein said obstruction mechanism further comprises a biasing mechanism that biases said actuator into a position in which said obstruction member is in the first position.

13. The waste container of claim 11, wherein said switch includes an elongate connecting portion extending between a manually accessible portion and said click stops.

14. The waste container of claim 1, further comprising a bag assembly arranged above said support portion, said bag assembly including the bag, said bag assembly comprising a foldable support that supports the bag, said support including two hinged portions and male or female connection elements on each of the inner and outer circumferential edges of each of said hinged portions configured to cooperate with one another when said hinged portions are folded against one another.

15. The waste container of claim 14, wherein said support further comprises a supplemental engagement system that aids in maintaining said hinged portions folded against one another.

16. The waste container of claim 15, wherein said supplemental engagement system comprises at least one projection on a surface of one of said hinged portions and a corresponding shaped aperture on the other of said hinged portions, said at least one projection and corresponding aperture being positioned to engage one another when said hinged portions are folded against one another.

17. The waste container of claim 15, wherein said supplemental engagement system comprises at least one boss on a surface of one of said hinged portions and a corresponding shaped aperture on the other of said hinged portions, said at least one boss and corresponding aperture being positioned to engage one another when said hinged portions are folded against one another.

18. The waste container of claim 1, wherein when in said first position, said obstruction member has first and second portions in said first plane and said obstruction member is rotated about an axis defined between said first and second portions such that after movement into said second position, said first portion is closer to said lid than said second portion when said lid is in said first position and said second portion is closer to a bottom of said base than said first portion.

19. The waste container of claim 18, wherein said axis defined between said first and second portions is defined by a single shaft that couples said obstruction member to said actuator.

20. The waste container of claim 18, wherein said axis defined between said first and second portions is defined by a first shaft that couples said obstruction member to said actuator and a second shaft that rotatably couples said obstruction member to said base.

* * * * *